US005836424A

United States Patent [19]

Allen

[11] Patent Number: 5,836,424

[45] Date of Patent: Nov. 17, 1998

[54] MULTIPLE LEVEL BUILDING WITH ELEVATOR HOISTWAY SEAL STRUCTURE

[76] Inventor: Thomas H. Allen, 1995 Roanoke, Boise, Id. 83712

[21] Appl. No.: 732,129

[22] Filed: Oct. 18, 1996

Related U.S. Application Data

[63] Continuation-in-part of Ser. No. 423,958, Apr. 18, 1995, abandoned.

[51] Int. Cl.[6] ..... B66B 13/06

[52] U.S. Cl. ..... 187/333; 49/120

[58] Field of Search ..... 187/313, 334, 187/318, 325, 333, 414; 49/303, 309, 310, 116, 120

[56] References Cited

U.S. PATENT DOCUMENTS

| | | | |
|---|---|---|---|
| 1,406,951 | 2/1922 | Fehr . | |
| 2,517,713 | 8/1950 | Rissler | 187/31 |
| 3,065,826 | 11/1962 | Tucker, Jr. | 187/52 |
| 3,074,124 | 1/1963 | Bergstedt | 20/19 |
| 3,425,162 | 2/1969 | Halpern | 49/425 |
| 3,734,238 | 5/1973 | Secresty et al. | 187/1 |
| 3,805,450 | 4/1974 | Forcina | 49/231 |
| 3,807,480 | 4/1974 | Smart | 160/1 |
| 3,817,161 | 6/1974 | Koplon | 98/39 |
| 3,912,049 | 10/1975 | Holland et al | 187/61 |
| 4,029,267 | 6/1977 | Slipper | 242/107.4 |
| 4,058,191 | 11/1977 | Balbo | 187/1 R |
| 4,115,953 | 9/1978 | Brosenius | 49/125 |
| 4,592,270 | 6/1986 | Vener | 98/39 |
| 4,637,176 | 1/1987 | Acock, Jr. | 52/30 |
| 4,651,469 | 3/1987 | Ngian et al. | 49/223 |
| 4,735,293 | 4/1988 | Everhart et al. | 187/56 |
| 4,987,638 | 1/1991 | Ribaudo | 16/89 |
| 5,083,639 | 1/1992 | Kappeler | 187/51 |
| 5,165,142 | 11/1992 | Pilsbury | 16/90 |
| 5,195,594 | 3/1993 | Allen et al. | 169/48 |
| 5,305,855 | 4/1994 | Rivera et al. | 187/56 |
| 5,383,510 | 1/1995 | Allen | 160/310 |
| 5,427,205 | 6/1995 | Saillio et al. | 187/334 |

FOREIGN PATENT DOCUMENTS

| | | |
|---|---|---|
| 0 478 938 A1 | 8/1991 | European Pat. Off. . |
| 2315-598 | 6/1975 | France . |
| 2582-343-A | 5/1985 | France . |
| 5-118180 | 5/1993 | Japan . |
| 6-72681 | 3/1994 | Japan . |
| 6032572 | 8/1994 | Japan . |
| 2 219 618 | 12/1989 | United Kingdom . |

*Primary Examiner*—Kenneth Noland
*Attorney, Agent, or Firm*—Seed and Berry LLP

[57] ABSTRACT

A multiple level building comprising an elevator system in which an elevator car moves between floors within an elevator hoistway which contains a door providing access to the hoistway from a corridor at each floor. Seal structures are provided between the hoistway door and a hoistway wall structure to substantially prevent smoke and gas from passing into or out of the hoistway, and to block water from entering the hoistway. A transverse seal structure has a wall-mounted portion with an angled seal engagement surface relative to the hoistway wall, and a door portion with an angled seal mating surface facing toward the hoistway wall and spaced apart from the seal engaging surface of the wall-mounted portion. A seal is provided between the seal engagement surface and the seal mating surface to seal the transverse space therebetween to prevent smoke and gas to pass therethrough in the event of a fire when the hoistway doors are in the closed position.

10 Claims, 18 Drawing Sheets

MULTIPLE LEVEL BUILDING WITH ELEVATOR HOISTWAY SEAL STRUCTURE

CROSS-REFERENCE TO RELATED APPLICATIONS

This application is a continuation-in-part of U.S. patent application Ser. No. 08/423,958, filed Apr. 18, 1995, now abandoned.

TECHNICAL FIELD

The present invention relates to multiple level buildings having one or more elevator hoistways and, more particularly, to a sealing structure mounted between a hoistway door and a hoistway entrance.

BACKGROUND OF THE INVENTION

The U.S. Fire Administration and the National Fire Protection Association (NFPA) estimate that 75% of all deaths, injuries and property damage during a building fire is a direct result of smoke. In a multi-story building having an elevator system with an elevator hoistway shaft, a natural ventilation cycle occurs in the elevator hoistway shaft called "stack effect," which draws smoke into the elevator hoistway shaft and exhausts it onto upper floors of the building. The taller the vertical hoistway shaft and the greater the differential between the inside and outside air temperatures, the greater the draft up the shaft. Historically, elevator systems have dealt primarily with providing a safe means of vertical transportation in multi-story buildings during non-emergency conditions, and have not addressed the issue of vertical smoke migration via the hoistway shaft.

Recently, the World Trade Center experienced an explosion and fire within a subterranean parking level. The smoke from the fire migrated through the elevator shafts and within minutes following the explosion caused the evacuation of the entire 110 story building complex. A substantial amount of smoke damage was experienced throughout the building because of the inability of the closed hoistway doors to prevent the migration of the smoke.

The basic configuration and operation of a conventional elevator system is well known. A multiple-level building contains a vertical hoistway shaft defined by a top, bottom and vertical structural wall through which an elevator cab travels between floor levels. Adjacent to each floor level is an opening in the structural wall that forms a hoistway entrance through which building occupants can safely pass when the elevator cab is adjacent to the hoistway entrance and registered with the lobby floor. An interlock mechanism connects the elevator car door to the hoistway door when the elevator car is positioned adjacent to a floor level and when the elevator car door is operated to an open or closed position.

The hoistway entrance opening comprises a head frame attached to a headwall and a pair of opposing lateral jambs attached to jamb walls. A sill is displaced below the hoistway door at the floor adjacent to the hoistway entrance opening. Together the head frame, lateral jambs and sill form a door frame. Conventional hoistway doors include one or more door panels that are movably supported on a horizontal support rail, which is connected to the headwall in a generally horizontal orientation. The hoistway doors move laterally within a vertical plane, and substantially cover the hoistway entrance opening when they are moved into the closed position. A clearance gap between the hoistway doors and the door frame and between multiple door panels is provided to allow the hoistway doors to open and close without excessive resistance. Movement of the hoistway doors is typically restricted to a lateral direction parallel to the hoistway entrance opening such that the clearance gap is maintained substantially constant as the hoistway doors move between open and closed positions.

Even though the clearance gap between the hoistway doors and the hoistway entrance opening is limited to approximately 0.375-inch, as by recognized industry standards, large quantities of air freely flow through the clearance gap between the elevator hoistway and the floor levels of the building. During a building fire, the stack effect can cause the conventional hoistway to become a smoke stack that quickly distributes smoke and toxic gases throughout the building. In addition, the clearance gaps allow water from a fire suppression system that is activated to flow into the hoistway. This water can cause significant electrical problems with the elevator car control system.

SUMMARY OF THE INVENTION

The present invention provides a hoistway door seal structure that limits the flow of air through a hoistway entrance opening when a hoistway door is in a closed position so as to restrict the passage of smoke and gas into and out of the hoistway in the event of a fire. The hoistway door seal structure also blocks water from entering the hoistway when water is present, such as from a fire suppression system or the like. In a preferred embodiment of the invention, a wall structure has an opening therein defining a hoistway entrance, and one or more hoistway doors cover the hoistway entrance. Seal structures are positioned between the hoistway doors and the wall structure. The single or multiple hoistway doors are movably supported by an elongated door support member positioned on the wall structure above each of the hoistway doors. The door support member directs the movement of the hoistway doors into sealable engagement with the seal structures as the hoistway doors are moved from a partially closed position to a fully closed position to cover the hoistway entrance, thereby forming a barrier that blocks smoke and gas migration into and out of the hoistway and that blocks water from flowing into the hoistway.

In one embodiment of the invention, each hoistway door panel is connected to support trucks, and each support truck has a pulley wheel that movably engages the door support member. The seal structures include a generally triangular shaped transverse seal structure having a wall-mounted portion connected to the headwall below the door support member and a door-mounted portion attached to the top portion of each hoistway door and spaced apart from the wall-mounted portion. The wall-mounted portion has an angled seal mating surface that extends horizontally away from the headwall at a selected angle. The door-mounted portion has a conversely-shaped triangular shape and has a seal engaging surface that extends horizontally at an angle relative to the headwall, such that the seal engaging surface is substantially parallel to the seal mating surface of the wall-mounted portion. A seal is connected to one of the seal mating surface and the seal engaging surface, and the seal sealably engages the other of the seal mating surface and the seal engaging surface to seal the space therebetween when the hoistway door is moved into the fully closed position to limit smoke, gas and water flow into or out of the hoistway. The seal is spaced apart from the other of the seal mating surface and the seal engaging surface when the hoistway door is moved out of the closed position toward the open position to a partially closed position.

In the preferred embodiment, the seal structures include a sill seal attached to a bottom portion of each hoistway door to sealably engage the sill when the hoistway doors are moved to the closed position. The sill has a generally vertically oriented seal engaging surface positioned at a selected angle relative to the headwall, and the sill seal has an elongated sealing surface positioned at the selected angle relative to the headwall with the sealing surface being substantially parallel to the seal engaging surface. The sealing surface sealably engages the seal engaging surface when the hoistway door is in the fully closed position, and the sealing surface is out of engagement with the seal engaging surface when the hoistway door is moved toward the open position to the partially closed position.

Accordingly, the instant invention provides an effective barrier to the passage of smoke, gas, and water between the hoistway door and the hoistway entrance, thereby providing an economical solution to the problem of smoke, gas, and water infiltration into the elevator hoistway shaft during a fire. Further, the instant invention maintains a high level of safety for passengers traveling in the elevator system.

BRIEF DESCRIPTION OF THE DRAWINGS

This invention, along with its many attendant advantages and benefits, will become better understood by reading the detailed description of the preferred embodiments with reference to the following drawings, wherein.

DETAILED DESCRIPTION OF THE PREFERRED EMBODIMENT

Figure 1:
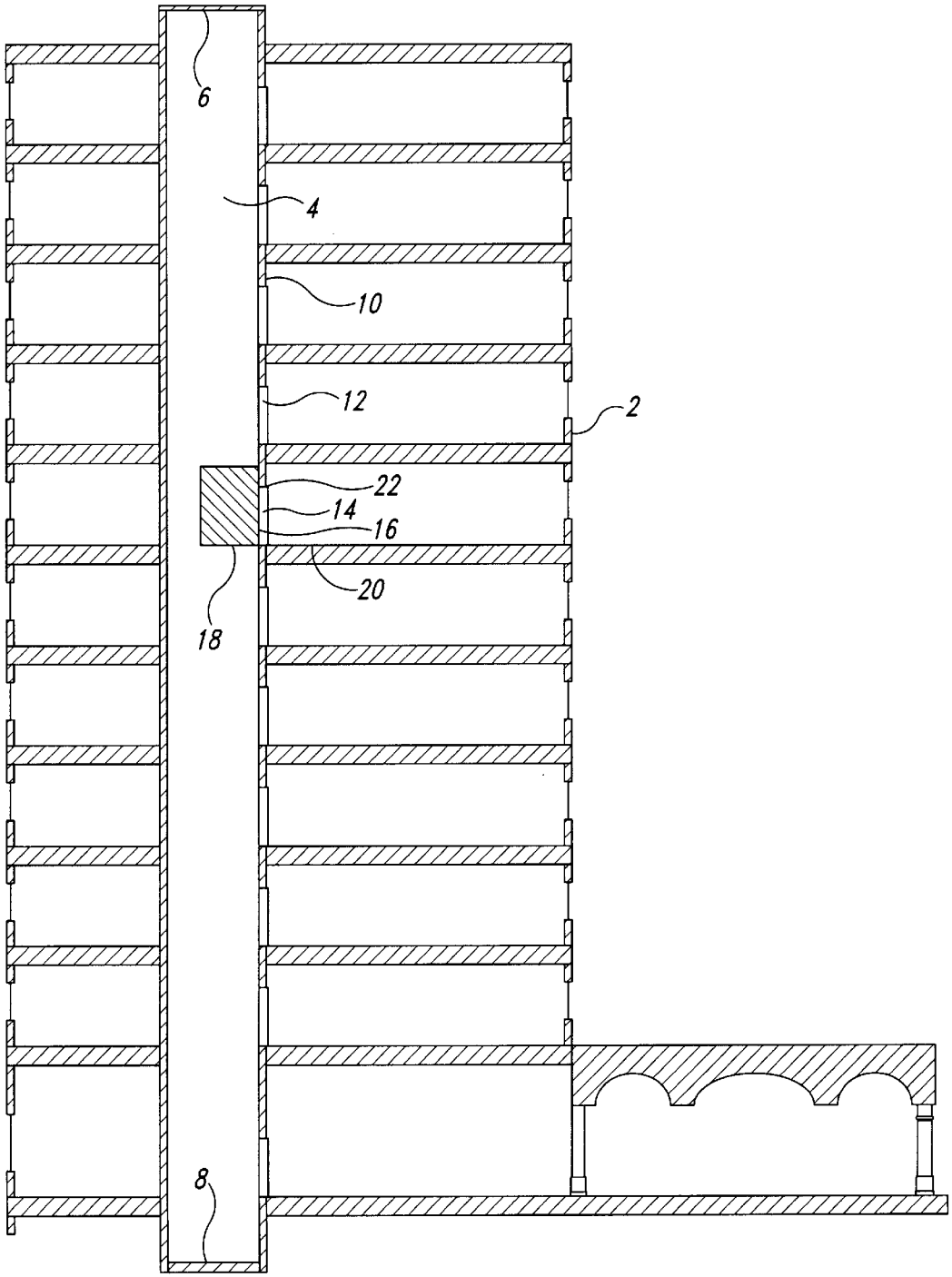
FIG. 1 is a sectional view of a multiple-level building, showing an elevator system with an embodiment of the elevator hoistway door seal structure in accordance with the present invention, a hoistway door seal structure being shown with a hoistway entrance on each level adjacent to an elevator lobby.

Referring now to the drawings wherein like reference characters designate identical or corresponding parts, and more particularly to FIG. 1 thereof, there is shown a multiple level building 2 with an elevator hoistway 4 having an upper limit 6 and a lower limit 8, with a wall structure 10 extending therebetween. A hoistway opening 12 in the wall structure 10 occurs at each level or floor of the building, defining a hoistway entrance 14 which is closeable by a movable hoistway door assembly 16. An elevator cab 18 is movably supported in the hoistway 4 for vertical movement between the floors of the building. When the elevator cab 18 is adjacent to an elevator lobby floor 20 of a floor and directly adjacent to the hoistway entrance 14, the hoistway door assembly 16 is moved by a conventional interlock system to an open position to allow passengers to pass through the hoistway entrance into or out of the elevator cab. When the elevator cab 18 is not adjacent to the elevator lobby floor 20, such as during travel between floors, the hoistway door 16 assembly remains in a closed position and blocks access into the hoistway 4.

Figure 2:
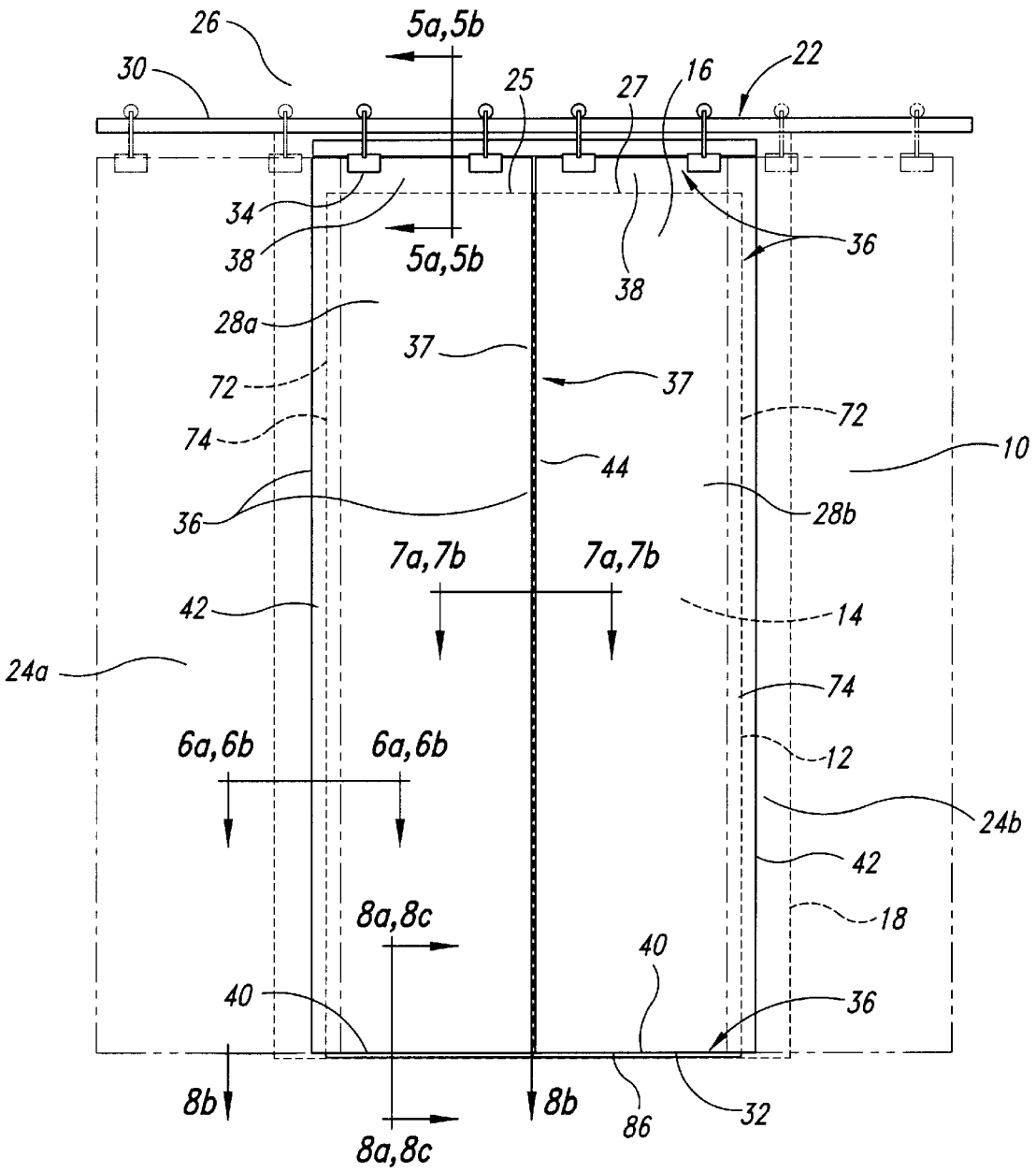
FIG. 2 is an enlarged side elevation view of the elevator hoistway seal structure of FIG. 1 with an opposing hoistway door arrangement shown supported from a support member above the hoistway entrance, the hoistway doors being shown in solid lines in a closed position and shown in phantom lines in an open position.

As best seen in FIG. 2, the hoistway door assembly 16 is movably supported by a conventional support rail 30 and door support members 34 to define a plurality of spaces or gaps between edge portions of the hoistway door assembly and the wall structure 10. A hoistway door seal structure 22 is adjacent to each hoistway entrance 14 and is positioned to provide seals between the hoistway door assembly 16 and the wall structure 10 around the hoistway opening 12 to block smoke, gas, and water from moving into the hoistway 4 and to prevent smoke and gas from moving out of the hoistway in the event of a fire in the building 2 (FIG. 1). A plurality of door seal structures used with a selected hoistway door configuration are disclosed in Applicant's co-pending U.S. patent application Ser. No. 08/423,958, entitled "Hoistway Door Seal Structure," filed Apr. 18, 1996, which is hereby incorporated by reference in its entirety.

The hoistway door seal structure 22 engageably seals the spaces or gaps between the hoistway door assembly 16 and the wall structure 10 when the hoistway door assembly is in a closed position to limit the flow of air through the hoistway opening 12. The hoistway door seal structure 22 includes seals, discussed in greater detail below, that are constructed of shaped, temperature resistive material or other material such as light gauge metal, silicone, or metallic brushes that can be slightly compressed when the hoistway door assembly 16 is moved into engagement therewith to create an effective seal between the hoistway door assembly and the wall structure 10 substantially around the perimeter of the elevator hoistway opening 12 with the hoistway door seal structure 22 of an alternate embodiment having multiple hoistway doors, a seal is provided adjacent to the meeting edges of the hoistway doors and a seal is adjacent to interdoor lateral edges between inner and outer door panels to seal spaces between hoistway doors and the door panels.

Although the embodiments described herein are described in terms of the seals around the hoistway door assembly 16 blocking the flow of smoke and gas in the event of a fire, the seals are also effective in blocking the flow of air or the like between the hoistway door assembly and the elevator hoistway 4 during normal building operation, or the like. In the event of a fire, the seals are also effective in restricting water flow from the fire floor into the hoistway shaft, thereby affording an increased level of safety to the passengers of the elevator car.

As best seen in FIG. 2, the hoistway entrance 14 in the wall structure 10 is a rectangular opening defined by a left lateral jamb 24*a*, a right lateral jamb 24*b*, a bottom sill 32, and a head 27 of a headwall 26 opposite the sill. The hoistway door seal structure 22 adjacent to the hoistway entrance 14 includes the hoistway door assembly 16 that moves laterally relative to the hoistway entrance in a generally vertical plane between an open position, shown in phantom lines, permitting access to the elevator hoistway, and a closed position, shown in solid lines. In the closed position, the hoistway door assembly 16 substantially covers the hoistway entrance 14.

In the illustrated embodiment, the hoistway door assembly 16 includes a pair of opposing hoistway doors 28*a* and 28*b* that are laterally movable relative to the hoistway entrance 14. The hoistway doors 28*a* and 28*b* are interconnected by a conventional interlock mechanism, such that the lateral movement of each of the hoistway doors between the open and closed positions is synchronized. The interlock mechanism is coupled to the hoistway doors 28*a* and 28*b* so as to engage a conventional elevator cab door assembly of the elevator cab 18 (FIG. 1) thereby simultaneously moving the hoistway doors and the elevator cab door assembly to the open or closed positions to allow ingress or egress from the elevator cab. Although the illustrated embodiment includes a pair of opposing hoistway doors 28*a* and 28*b*, the door assembly 16 can have other configurations, such as a single door configuration, or a configuration having a pair of opposing doors with multiple door panels, as discussed below.

The pair of opposing hoistway doors 28*a* and 28*b* are movably supported outwardly adjacent to the hoistway entrance 14 by an elongated door support member 30 that is securely mounted to the headwall 26 in a generally horizontal position above the hoistway entrance 14. Each of the hoistway doors 28*a* and 28*b* are movably attached to the door support member 30 by a pair of the door supports 34 that move laterally along the door support member when the hoistway doors move between the open and closed positions.

A plurality of seal structures 36 are positioned between the hoistway doors 28*a* and 28*b* and the wall structure 10 around the hoistway entrance 14. The seal structures 36 substantially seal spaces between the hoistway doors 28*a* and 28*b* and the wall structure 10 when the hoistway doors are in the closed position. Accordingly, the seal structures 36 restrict the passage of gas, smoke, and water through the spaces in the event of a fire. The hoistway doors 28*a* and 28*b* move into sealable engagement with the seal structures 36 as the hoistway doors move from a partially closed position to a fully closed position.

Figure 3:
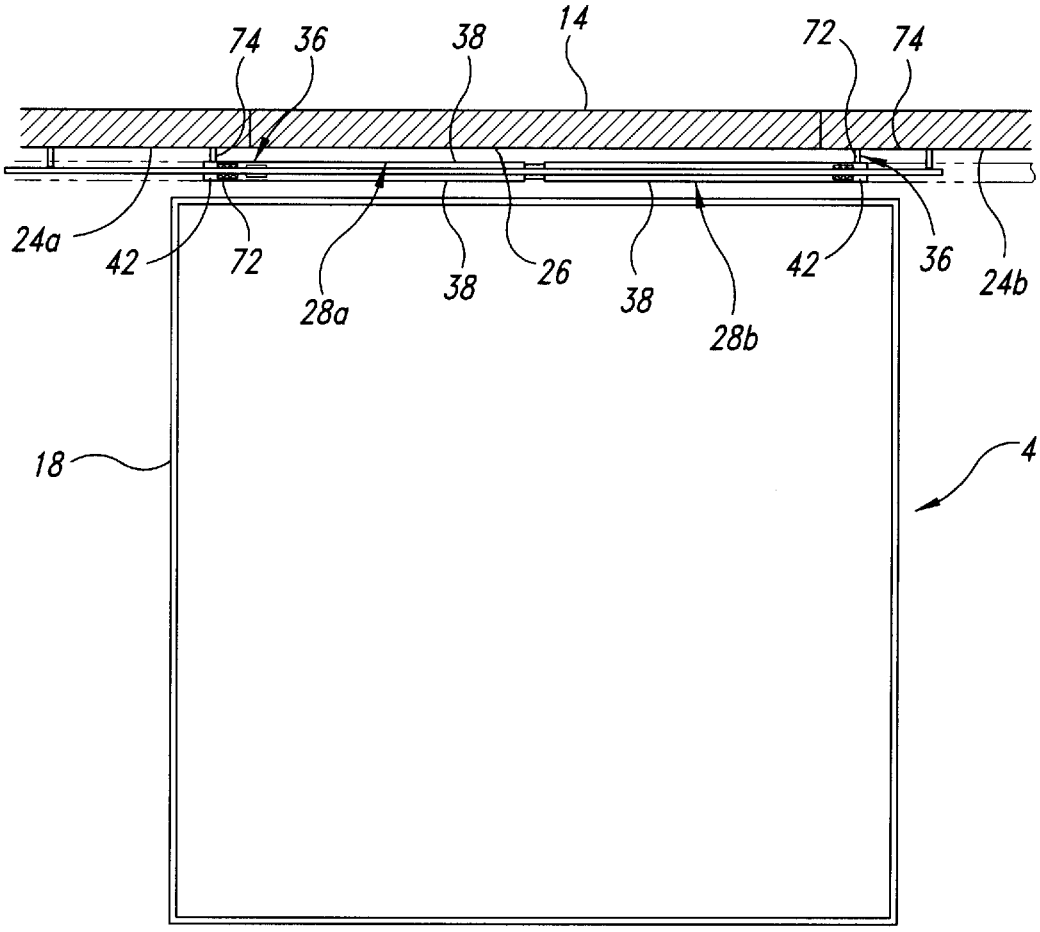
FIG. 3 is an enlarged plan view of a hoistway entrance of FIG. 1 with a double hoistway door arrangement shown in phantom lines in the open position and shown in solid lines in a closed position.

As best seen in FIGS. 2 and 3, the opposing hoistway doors 28*a* and 28*b* are shown adjacent to the elevator cab 18. The hoistway doors 28*a* and 28*b* move between the open position, shown in phantom lines, to permit access to the elevator cab 18, and a closed position, shown in solid lines, wherein the hoistway doors substantially cover the hoistway entrance 14 and blocks access to the elevator cab and to the hoistway 4. As discussed in greater detail below, the seal structures 36 are provided between the top transverse edge 38 (FIG. 2) of the hoistway doors 28*a* and 28*b* and the headwall 26, and between a bottom edge 40 of the hoistway doors and the sill 32. Seal structures 36 are also provided between trailing edges 42 of the hoistway doors 28*a* and 28*b* and the right and left jamb wall 24*a* and 24*b*, respectively.

Figure 4:
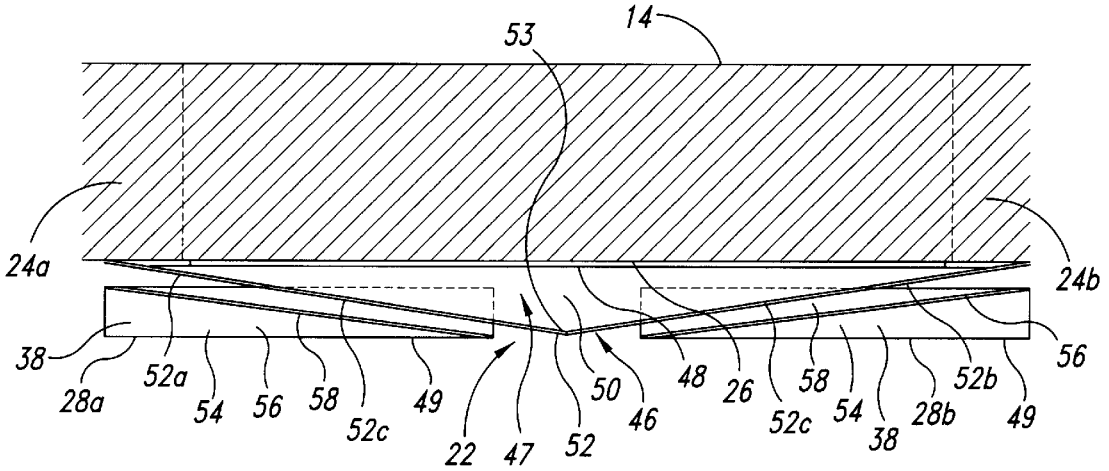
FIG. 4 is an enlarged schematic plan view of a transverse edge of the hoistway doors showing an angled transverse seal structure; a door support member and support trucks are not shown for purposes of clarity.
Figure 5A:
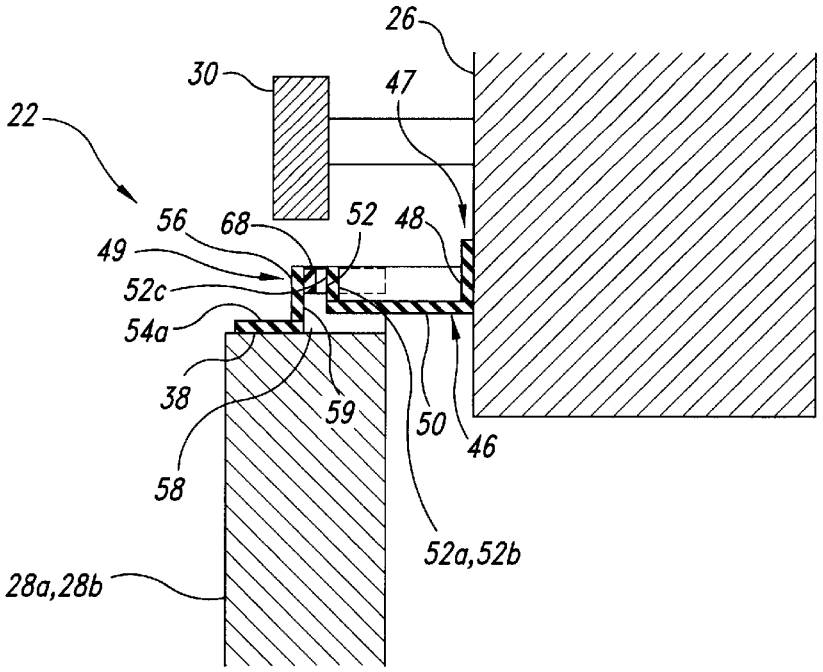
FIG. 5*a* is an enlarged cross-sectional view taken substantially along line 5*a,b*—5*a,b* of FIG. 2 showing a transverse seal structure; door support trucks are not shown for purposes of clarity.

As best seen in FIGS. 4 and 5*a*, the hoistway door seal structure 22 includes a transverse seal structure 46 having an essentially triangular shaped wall-mounted portion 47 securely mounted to the headwall 26. The wall-mounted portion 47 is generally horizontally oriented and has a generally U-shaped cross section (FIG. 5*a*) defined by a vertical first leg 48 fastened to the headwall 26, a bottom web 50 attached to the vertical leg 48 and extending away from the headwall 26, and a vertical second leg 52 spaced apart from the first leg and angled in two directions relative to the headwall. The bottom web 50 has a horizontally extending edge that extends outwardly in the two directions away from an apex 53 (FIG. 4) aligned with a vertical centerline of the hoistway entrance 14. The horizontal edge of the bottom web 50 is positioned progressively closer to the headwall 26 as the bottom web extends away from the apex 53.

The second leg 52 of the transverse seal structure 46 has left and right portions 52*a* and 52*b* that are attached to the horizontal edge and extend therealong, and are connected to each other at the apex 53. Each of the left and portions 52*a* and 52*b* have a generally vertically oriented seal mating surface 52*c* that faces away from the headwall 26. A portion of the seal mating surface 52*c* of each left and right portions 52*a* and 52*b* that is adjacent to the apex 53 is spaced further from the headwall 26 than a laterally outer portion of the respective seal mating surface that is positioned above the respective left or right jamb walls 24*a* and 24*b*. Accordingly, the left and right portions 52*a* and 52*b* each extend outwardly from the apex 53 and inwardly toward the headwall 26.

The transverse seal structure 46 has door-mounted portion 49 outwardly adjacent to the wall-mounted portion 47 when the hoistway doors 28*a* and 28*b* are in the closed position. Each door-mounted portion 49 includes a horizontal leg 54 securely mounted to a transverse top edge 38 of the respective hoistway door 28*a* and 28*b* , and a vertical leg 56 which extends upwardly away from the transverse edge 38 of the hoistway door. The horizontal leg 54 has a substantially triangular shape with the hypotenuse of the triangle being connected to the vertical leg 56 and being at an angle relative to the headwall 26, so the vertical leg is substantially parallel to the respective left or right portion 52*a* or 52*b* of the transverse seal structure's second leg 52 when the hoistway doors 28*a* and 28*b* are in the closed position. The vertical leg 56 of each door-mounted portion 49 is spaced apart from the second leg 51 of the respective left or right portion 52*a* or 52*b* so as to provide a transverse space 58 therebetween.

As best seen in FIG. 5*a*, the vertical leg 56 of each door-mounted portion 49 has a seal engaging surface 59 that faces the seal mating surface 52*c* of the wall-mounted portion 47. An elongated transverse seal 68 is mounted on each of the seal engaging surfaces 59 and extends into a transverse space 58 formed between the seal engaging surface 59 to which it is mounted and the opposing seal mating surface 52*c*, and is in sealable engagement with the opposing seal mating surface 52*c* when the hoistway doors 28*a* and 28*b* are in the fully closed position. When the hoistway doors are in the partially closed position the elongated transverse seals 68 are out of engagement with the seal mating surfaces 52*c*.

When the hoistway doors 28*a* and 28*b* are moved laterally between the partially closed position, as shown in FIG. 5*a*, and the open position, the transverse seals 68 remain out of engagement with the opposing seal mating surfaces 52*c* of the wall-mounted portion 47, thereby minimizing frictional resistance to lateral movement of the hoistway doors relative to the hoistway opening 14. When the hoistway doors 28*a* and 28*b* are moved toward the closed position, the opposing seal engaging surface 59 and seal mating surface 52*c* remain substantially parallel, and the distance therebetween decreases as the hoistway doors move closer together because of the angular orientation of the opposing seal engaging surface and seal mating surface. As the hoistway doors 28*a* and 28*b* move into the fully closed position, the elongated transverse seals 68 are pressed against and sealably engage the opposing seal mating surfaces 52*c* to seal the transverse space 58 and prevent smoke and gas migration therethrough. In the preferred embodiment, each of the elongated transverse seals 68 is constructed of shaped, resilient, temperature resistive material that is slightly compressed when the hoistway doors 28*a* and 28*b* are moved to the fully closed position.

Figure 5B:
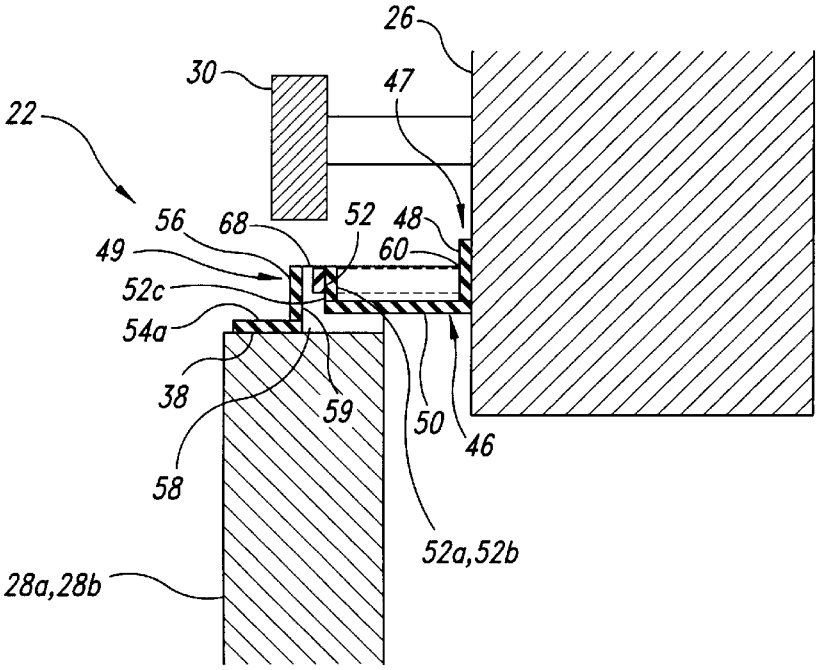
FIG. 5*b* is an enlarged cross-sectional view taken substantially along line 5*a,b*—5*a,b* of FIG. 2 showing an alternate embodiment of the transverse seal structure; door support trucks are not shown for purposes of clarity.

As best seen in FIG. 5*b*, an alternate embodiment of the transverse seal structure 46 has the elongated transverse seal 68 mounted to the seal mating surfaces 52*c* of the wall-mounted portion 47 and extends toward the opposing seal engaging surface 59 and into the transverse space 58. When the hoistway doors 28*a* and 28*b* are moved laterally into the fully closed position, the seal engaging surfaces 59 of the door-mounted portion 49 is pressed into sealable engagement with the opposing transverse seals 68 to substantially seal the transverse space 58 and prevent migration of smoke and gas therethrough.

As best seen in FIGS. 2 and 3, each of the hoistway doors 28*a* and 28*b* has a trailing edge 42 that extends between the top transverse edge 38 and the bottom edge 40 (FIG. 2) of the respective hoistway door. The hoistway doors 28*a* and 28*b* are configured such that a trailing edge space 72 is provided between the trailing edge 42 and the left and right jamb walls 24*a* and 24*b* when the hoistway doors are in the fully closed position, as shown in solid lines. A trailing edge seal structure 74 is provided between each of the trailing edges 42 and the respective jamb wall 24*a* and 24*b* to fill and seal the trailing edge space 72.

Figure 6A:
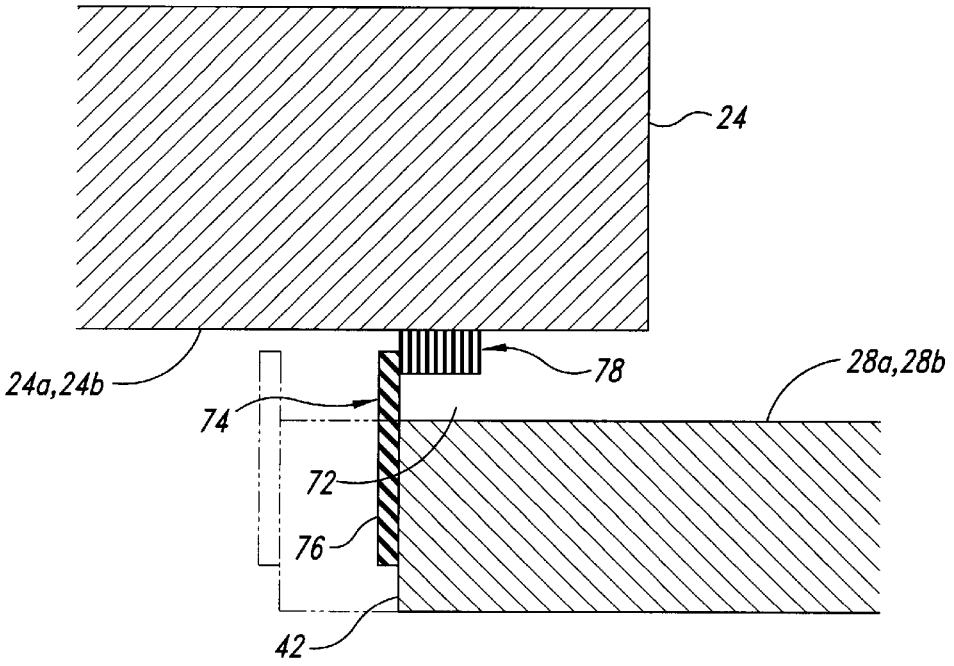
FIG. 6*a* is an enlarged cross-sectional view taken substantially along the line 6*a,b*—6*a,b* of FIG. 2 with a trailing edge seal structure shown in phantom lines in an unsealed position with the hoistway door in a partially closed position and shown in solid lines in a sealed position with the hoistway door in the closed position.

As best seen in FIG. 6*a*, the trailing edge seal structure 74 includes an elongated lateral extension 76 secured to the trailing edge 42 of each of the hoistway doors 28*a* and 28*b*.

The lateral extensions 76 extend along the length of the trailing edge portion 42 of the respective door. The lateral extension 76 also extends toward the respective jamb wall 24*a* and 24*b* and into the trailing edge spaces 72. A trailing edge lateral seal 78 is attached to each jamb wall 24*a* and 24*b* and extends toward the respective hoistway door 28*a* and 28*b* and into the trailing edge space 72 in an overlapping relationship with the associated lateral extension 76.

When the hoistway doors 28*a* and 28*b* are moved between the partially closed position, shown in phantom lines, and the open position, the lateral extensions 76 do not engage the respective trailing edge lateral seals 78, thereby minimizing frictional resistance to lateral movement of the hoistway doors. When the hoistway doors 28*a* and 28*b* are moved to the fully closed position, shown in solid lines, each of the lateral extensions 76 is pressed against and into sealable engagement with the trailing edge lateral seal 78 to seal the trailing edge space 72 along the height of the hoistway doors. In the preferred embodiment, each of the trailing edge lateral seals 78 is a shaped, resilient, temperature resistive material that is slightly compressed by the respective lateral extension 76 when the hoistway doors 28*a* and 28*b* are moved to the fully closed position.

Figure 6B:
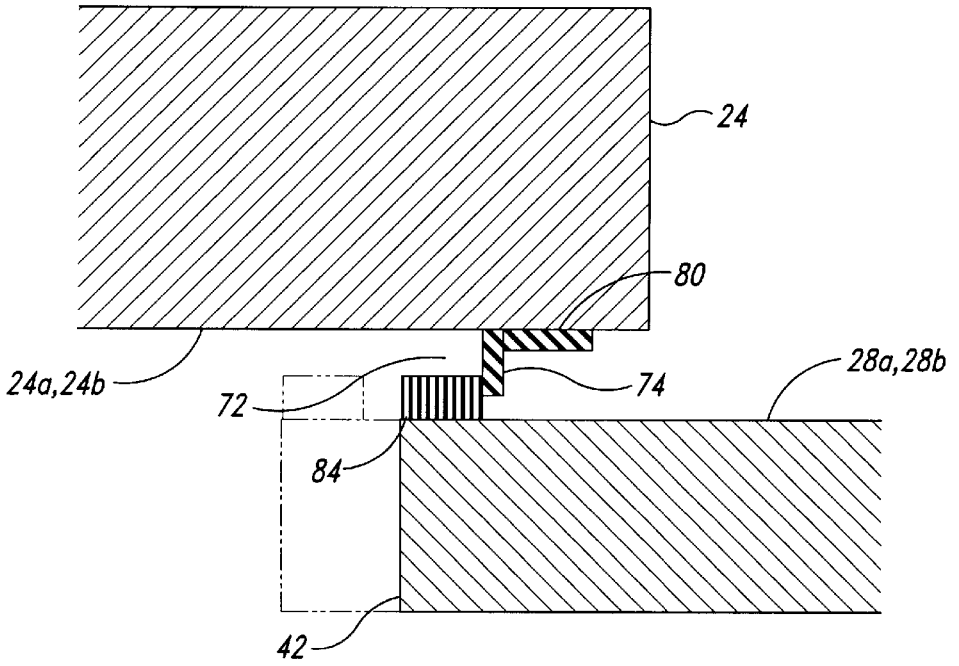
FIG. 6*b* is an enlarged cross-sectional view taken substantially along the line 6*a,b*—6*a,b* of FIG. 2 showing an alternate embodiment of the trailing edge seal structure, the trailing edge sealing structure being shown in phantom lines in an unsealed position with the hoistway door in a partially closed position and shown in solid lines in a sealed position with the hoistway door in the closed position.

In an alternate embodiment illustrated in FIG. 6*b*, the trailing edge seal structure 74 includes an elongated lateral extension 80 that is secured to each of the left and right jamb walls 24*a* and 24*b*. The lateral extension 80 projects outwardly from the respective jamb wall 24*a* and 24*b* toward the respective hoistway doors 28*a* and 28*b*. Each of the lateral extensions 80 is an L-shaped bracket with one leg parallel to the respective jamb wall 24*a* and 24*b*, and a second leg perpendicular to the jamb wall and extending into the trailing edge space 72. The elongated trailing edge lateral seal 84 is securely attached to the hoistway doors 28*a* and 28*b* adjacent to the respective trailing edge 42. The trailing edge lateral seal 84 extends into the trailing edge space 72 toward the respective jamb wall 24*a* and 24*b*, and the trailing edge lateral seal is positioned in an overlapping relationship with the second leg of the associated lateral extension 80.

When the hoistway doors 28*a* and 28*b* are moved between the partially closed position, shown in phantom lines, and the open position, the trailing edge lateral seal 84 is out of engagement with the elongated lateral extension 80 so as to minimize frictional resistance to lateral movement of the hoistway doors. When the hoistway doors 28*a* and 28*b* are moved to the fully closed position, the trailing edge lateral seal 84 presses against and sealably engages the second leg of the lateral extension 80, thereby sealing the trailing edge space 72, for example, to limit smoke, gas, and water flow therethrough in the event of a fire or the like. Although the lateral extension 80 of the alternate embodiment is illustrated as an L-shaped member, the lateral extension of another alternate embodiment is a blade structure against which the trailing edge lateral seal 84 sealably presses to seal the trailing edge space 72.

Figure 7A:
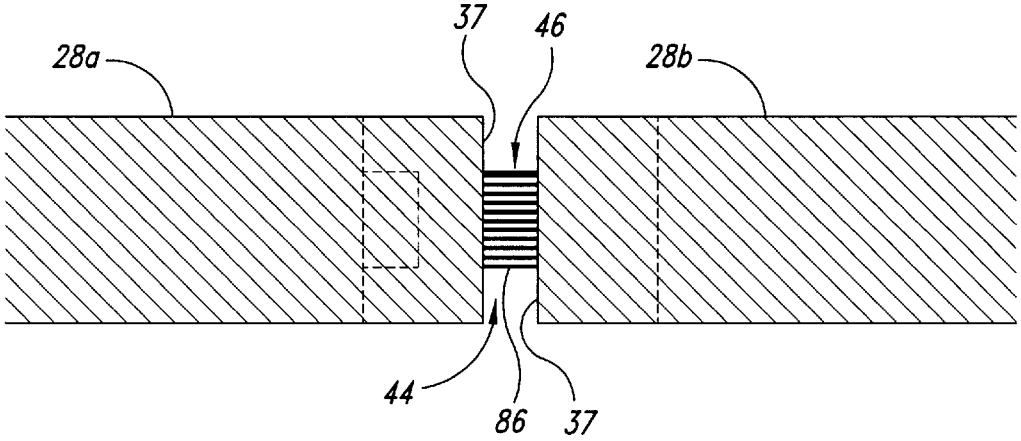
FIG. 7*a* is an enlarged cross-sectional view taken substantially along line 7*a,b*—7*a,b* of FIG. 2 showing a meeting edge seal structure between the opposing hoistway doors, the meeting edge seal structure being shown in phantom lines in an unsealed position with the hoistway doors in a partially closed position and shown in solid lines in a sealed position with the hoistway doors in the closed position.

As best seen in FIGS. 2 and 7*a*, each of the hoistway doors 28*a* and 28*b* has a meeting edge 37 that extends between the top transverse edge 38 (FIG. 2) and the bottom edge 40 (FIG. 2) of the hoistway door. The hoistway doors 28*a* and 28*b* are configured such that a meeting edge space 44 is provided between the meeting edges 37 of the hoistway doors 28*a* and 28*b* when the hoistway doors are in the fully closed position, as shown in solid lines. A meeting edge seal structure 46 (FIG. 7*a*) is provided between the meeting edges 37 of each hoistway door 28*a* and 28*b* so as to seal the meeting edge space 44 when the hoistway doors are in the closed position. In the preferred embodiment, the meeting edge seal structure 46 is attached to the meeting edge 37 of one hoistway door 28*a* such that the meeting edge seal structure travels with that hoistway door. The meeting edge seal structure 46 has an elongated seal 86 that extends toward the other hoistway door 28*b* and that is sized to sealably engage the meeting edge 37 of the other hoistway door when the hoistway doors are in the fully closed position.

Figure 7B:
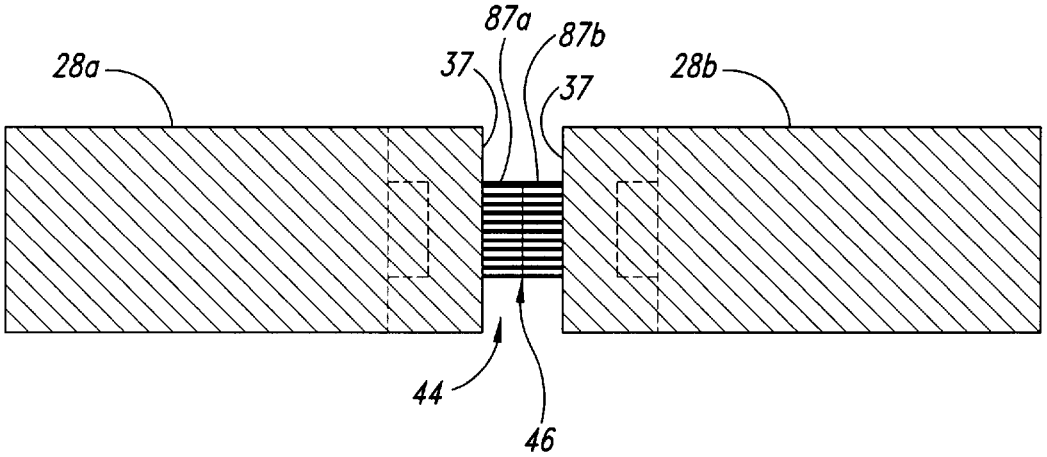
FIG. 7*b* is an enlarged cross-sectional view taken substantially along line 7*a,b*—7*a,b* of FIG. 2 showing an alternate embodiment of the meeting edge seal structure, the meeting edge seal structure being shown in phantom lines in an unsealed position with the hoistway doors in the partially closed position, and shown in solid lines in a sealed position with the hoistway doors in the closed position.

In an alternate embodiment, as best seen in FIG. 7*b*, the meeting edge seal structure 46 includes elongated seals 87*a* and 87*b* each mounted to a respective one of the leading edge 37 of the hoistway doors 28*a* and 28*b*. The elongated seals 87*a* and 87*b* each travel with its respective hoistway doors. The seals 87*a* and 87*b* are shaped and sized to extend into the meeting edge space 44 and into sealable engagement with each other when the hoistway doors 28*a* and 28*b* are in the fully closed position, thereby sealing the meeting edge space.

Figure 8A:
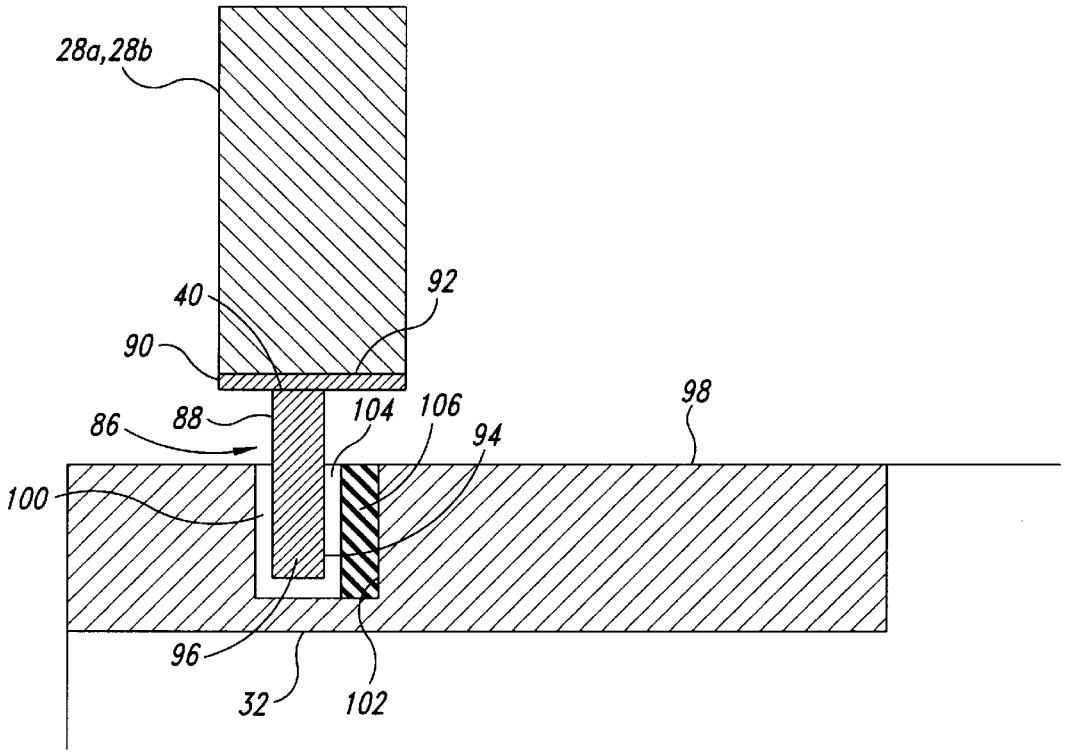
FIG. 8*a* is an enlarged cross-sectional view taken substantially along line 8*a,c*—8*a,c* of FIG. 2 showing a sill seal structure.

Referring to FIG. 2, the bottom edge 40 of each hoistway door 28*a* and 28*b* is positioned above the sill 32 at a selected distance that defines a sill space 86 between the hoistway doors and the sill. As best seen in FIG. 8*a*, a sill seal structure 88 is provided along the bottom edge 40 of each hoistway door 28*a* and 28*b* to seal the sill space 86 when the hoistway doors are in the fully closed position. The sill seal structure 88 has a generally T-shaped bottom edge plate 90 having a horizontal leg 92 attached to the bottom edge 40 of the respective hoistway door 28*a* and 28*b* and a vertical leg 94 extending downwardly from the horizontal leg 92 into the sill space 86. A tread surface 98 is attached to the bottom sill 32 and has a guide groove 100 that movably receives at least a lower end portion of the vertical leg 94 as the hoistway doors move laterally between the open and fully closed positions.

Figure 8B:
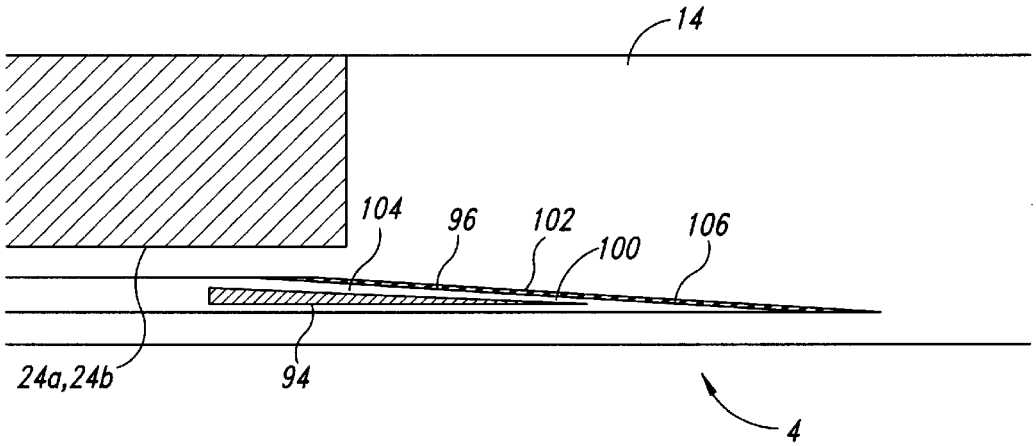
FIG. 8*b* is an enlarged cross-sectional view taken substantially along line 8*b*—8*b* of FIG. 2 showing the sill seal structure.

As best seen in FIG. 8*b*, the vertical leg 94 has a wedge-shaped cross-sectional area with an angled surface 96 that converges from the trailing edge 42 of the hoistway door 28*a* and 28*b* toward the leading edge of the hoistway door. The guide groove 100 has a corresponding wedge-shaped cross section with a matching angled surface 102 that converges toward the center of the hoistway entrance at an angle substantially corresponding to the angle of the vertical leg's angled surface 96. The guide groove 100 is shaped and sized to provide a sill groove space 104 between the vertical leg's angled surface 96 and the guide groove's matching angled surface 102 when the hoistway doors 28*a* and 28*b* are in the partially closed position, as illustrated in FIGS. 8*a* and 8*b*. An elongated sill seal 106 is positioned within the sill groove space 104 and attached to the matching angled surface 102 on a side thereof toward the vertical leg's angled surface 96. The sill seal 106 is positioned so the vertical leg's angled surface 96 is pressed into sealable engagement with the sill seal when the respective hoistway door 28*a* and 28*b* is in the closed position, thereby sealing the sill space 86 to prevent migration of smoke, gas, and water therethrough.

Figure 8C:
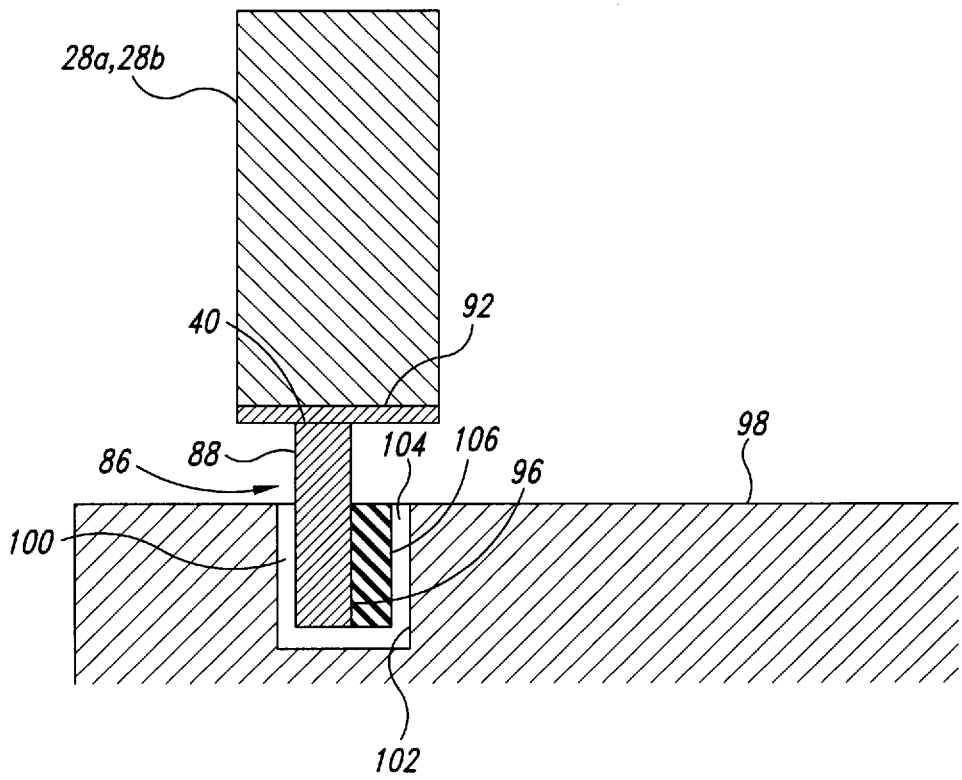
FIG. 8*c* is an enlarged cross-sectional view taken substantially along lines 8*a,c*—8*a,c* of FIG. 2 showing an alternate embodiment of the sill seal structure.

As best seen in FIG. 8*c*, an alternate embodiment of the sill seal structure 88 includes the elongated sill seal 106 that is positioned within the sill groove space 104 and attached to the vertical leg's angled surface 96 on a side thereof toward the matching angled surface 102 of the guide groove 100. Accordingly, the sill seal 106 travels with the respective hoistway door 28*a* and 28*b* between the open position and the fully closed position. When the hoistway doors 28*a* and 28*b* are moved between the open and partially closed positions illustrated in FIG. 8*c*, the sill seal 106 is out of engagement with the matching angled surface 102 of the guide groove 100 so as to minimize frictional resistance to lateral movement of the hoistway doors. When the hoistway doors 28*a* and 28*b* are in the fully closed position, the sill seal 106 is pressed into sealable engagement with the matching angled surface 102 of the guide groove 100, thereby sealing the sill space 86.

Figure 9:
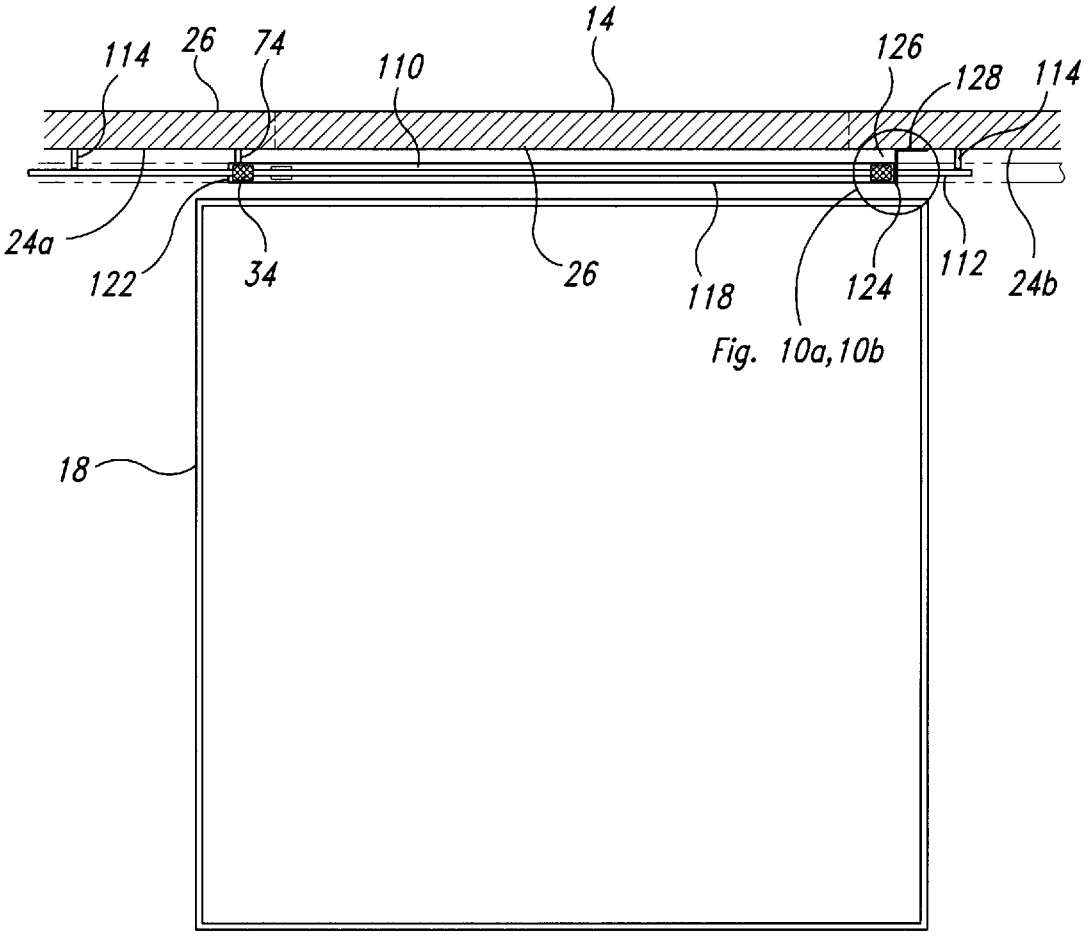
FIG. 9 is an enlarged plan view of a hoistway entrance of FIG. 1 substantially covered with a single hoistway door that is movably supported by a support member, the hoistway door being shown in phantom lines in an open position and shown in solid lines in a closed position.

In an alternate embodiment of the present invention illustrated in FIG. 9, a single hoistway door 110 is movably supported on an elongated support member 112 by a pair of door supports 34 in the manner discussed above. The single hoistway door 110 moves between an open position, shown in phantom lines, that permits access to the elevator cab 18, and a fully closed position, shown in solid lines, wherein the hoistway door covers the hoistway entrance 14. The elongated door support member 112 is rigidly secured to the headwall 26 with brackets 114 in a generally horizontal orientation above the hoistway entrance 14. The door support member 112 is configured to move the hoistway doors horizontally relative to the hoistway entrance 14 as described above. Seals are formed between the transverse edge 118 of the door and the headwall 26 and between the bottom edge of the door and the sill, not shown, in a substantially similar manner discussed above for one of the hoistway doors 28*a* and 28*b* (not shown). Similarly, seals are formed between the trailing edge of the door 122 and the left jamb wall 24*a* similar to the trailing edge seal structure 74 discussed above.

The single hoistway door 110 includes a leading edge 124 that is positioned outwardly away from the right jamb wall 24*b* to define a leading edge lateral space 126 between the hoistway door and the jamb wall. A leading edge seal structure 128 is mounted to the right jamb wall 24*b* and positioned such that the leading edge 124 of the single hoistway door 110 moves into sealable engagement therewith when the hoistway door is in the closed position thereby forming a seal within the leading edge lateral space 126.

Figure 10A:
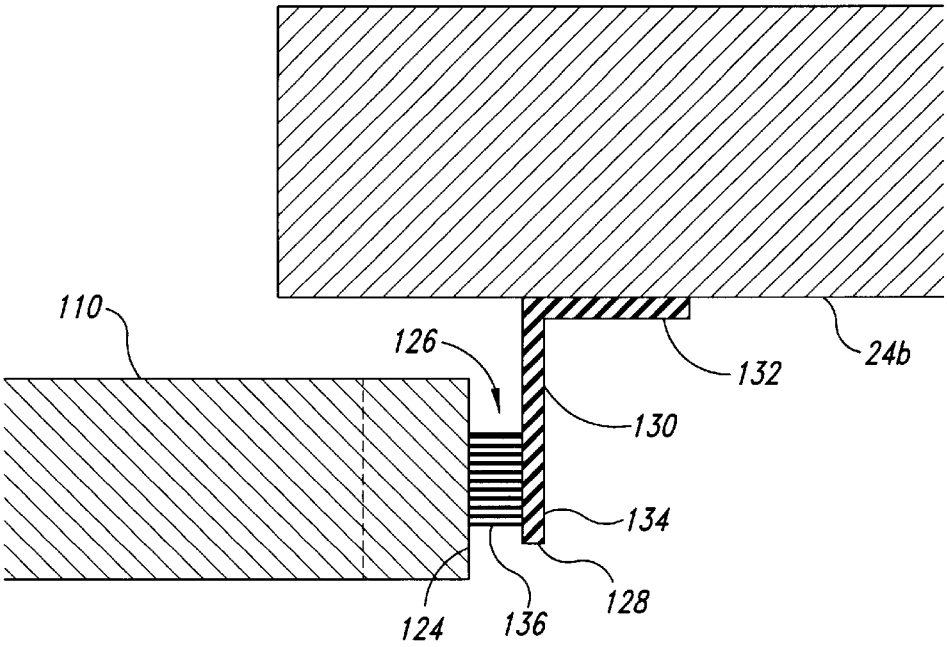
FIG. 10*a* is an enlarged plan view taken substantially at Detail 10*a,b* of FIG. 9 showing a leading edge seal structure of the single hoistway door, the hoistway door being shown in phantom lines in partially closed position and shown in solid lines in a closed position.

As best seen in FIG. 10*a*,the leading edge seal structure 128 has an elongated leading edge lateral extension 130 that has an L-shaped cross-section, wherein an attachment leg 132 of the extension is securely fastened to the right jamb wall 24*b*. An engagement leg 134 of the leading edge lateral extension 130 extends perpendicularly away from the right jamb wall 24*b* and substantially parallel to the leading edge 124 of the single hoistway door 110. An elongated leading edge lateral seal 136 is securely attached to the engagement leg 134 along the length of the lateral extension 130. The leading edge lateral seal 136 extends toward the hoistway door 110 such that the leading edge 124 of the hoistway door sealably engages the leading edge lateral seal 136 when the hoistway door is in the fully closed position, as shown in solid lines. Accordingly, the leading edge lateral seal 136 extends across the leading edge lateral space 126 and forms a seal therein between the lateral extension 130 and the hoistway door 110.

In the preferred embodiment, the engagement leg 134 is a substantially rigid, blade-like member, and the leading edge lateral seal 136 is a shaped, resilient, temperature resistive material that is slightly compressed by the leading edge 124 when the hoistway door 110 is moved to the closed position.

Figure 10B:
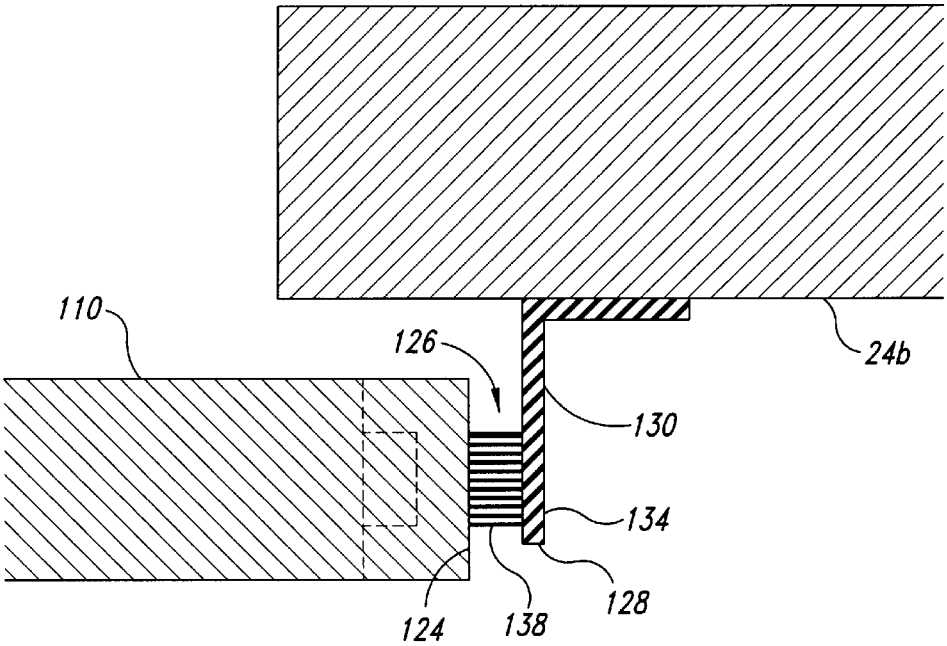
FIG. 10*b* is an enlarged cross-sectional view taken substantially at Detail 10*a,b* of FIG. 9 showing an alternate embodiment of the leading edge seal structure, the hoistway door being shown in phantom lines in the partially closed position and shown in solid lines in a closed position.

As best seen in FIG. 10*b*, an alternate embodiment of the leading edge seal structure 128 has the leading edge lateral extension 130 mounted to the right jamb wall 24*b* as discussed above, and a leading edge lateral seal 138 is securely attached to the length of the leading edge 124 of the hoistway door 110. The leading edge lateral seal 138 extends away from the leading edge 124 toward the leading edge lateral extension 130. When the hoistway door 110 is in the fully closed position, shown in solid lines, the leading edge lateral seal 138 is pressed into sealable engagement with the engagement leg 134 of the leading edge lateral extension 130 and seals the leading edge lateral space 126.

Figure 11:
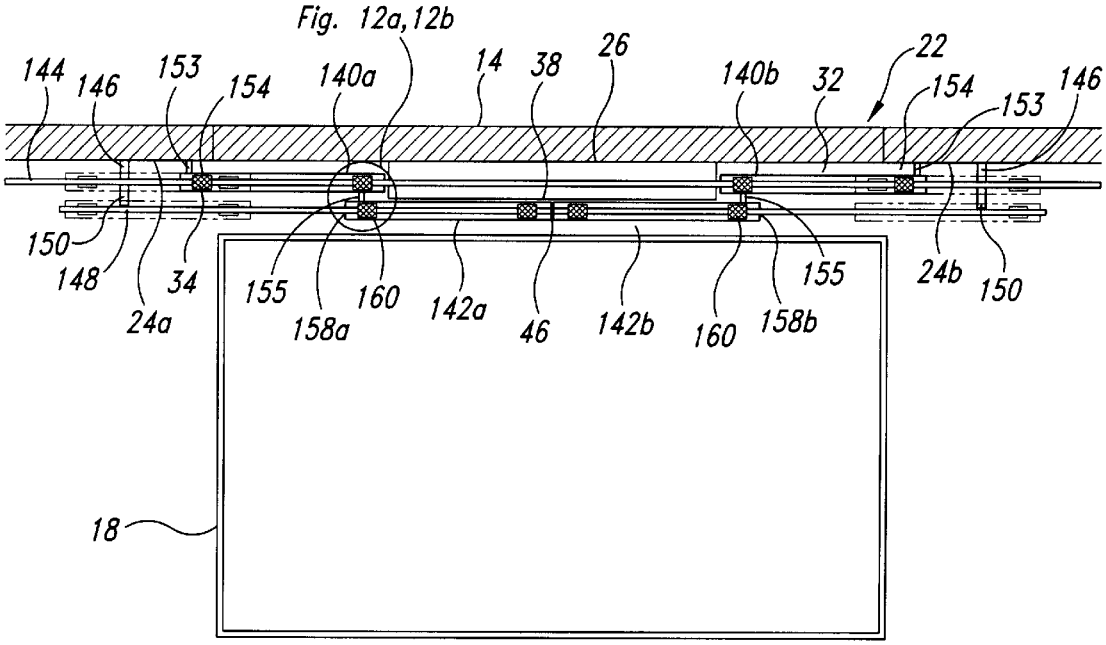
FIG. 11 is an enlarged plan view of the hoistway entrance of FIG. 1 substantially covered with a pair of opposing hoistway door assemblies that are movably supported by a support member, the hoistway door assemblies being shown in phantom lines in an open position and shown in solid lines in a closed position.

An alternate embodiment of the present invention is illustrated in FIG. 11 wherein the hoistway door seal structure 22 includes opposing left and right inner hoistway doors 140*a* and 140*b* and opposing left and right outer hoistway doors 142*a* and 142*b*. The inner and outer hoistway doors 140*a*, 140*b*, 142*a*, and 142*b* move together between an open position, shown in phantom lines that permits access to the elevator cab 18, and a fully closed position, shown in solid lines, where the inner and outer hoistway doors substantially cover the hoistway entrance 14.

The inner hoistway doors 140*a* and 140*b* are supported outwardly adjacent to the hoistway entrance 14 by an elongated inner door support member 144 that is rigidly secured to the headwall 26 with brackets 146 in a generally horizontal orientation above the hoistway entrance. The outer pair of hoistway doors 142*a* and 142*b* are supported outwardly adjacent to the inner hoistway doors 140*a* and 140*b* by an elongated outer door support member 148 that is secured to the inner elongated door support member 144 with brackets 150. The outer door support member 148 is secured in a generally horizontal orientation such that the inner door support member 144 is between the headwall 26 and the outer door support member. Each of the inner hoistway doors, 140*a* and 140*b* are movably supported on the inner door support member 144 by a pair of the door supports 34 discussed above.

As best seen in FIG. 11, trailing edge seals 153 are provided between the trailing edge 154 of the inner hoistway doors 140*a* and 140*b* and the respective jamb walls 24*a* and 24*b* similar to the trailing edge seal structures 74 discussed above. Likewise, sill seals are provided between bottom edges of the inner hoistway doors 140*a* and 140*b* and of the outer hoistway doors 142*a* and 142*b* and the sill 32 as discussed above. A meeting edge seal structure 46 is provided between the meeting edges 38 of the outer hoistway doors 142*a* and 142*b* as discussed above.

The left inner hoistway door 140*a* is positioned outwardly away from the left outer hoistway door 142*a* to define a left interdoor lateral space 158*a* between the left inner hoistway door and the left outer hoistway door. The right inner hoistway door 140*b* is positioned outwardly away from the right outer hoistway door 142*b* to define a right interdoor lateral space 158*b* between the right inner hoistway door and the right outer hoistway door. An interdoor seal structure 160 is attached to each pair of the inner and outer hoistway doors 140*a*/142*a* and 140*b*/142*b*, so as to seal the interdoor spaces later spaces 158*a* and 158*b* when the hoistway doors are in the closed position.

Figure 12A:
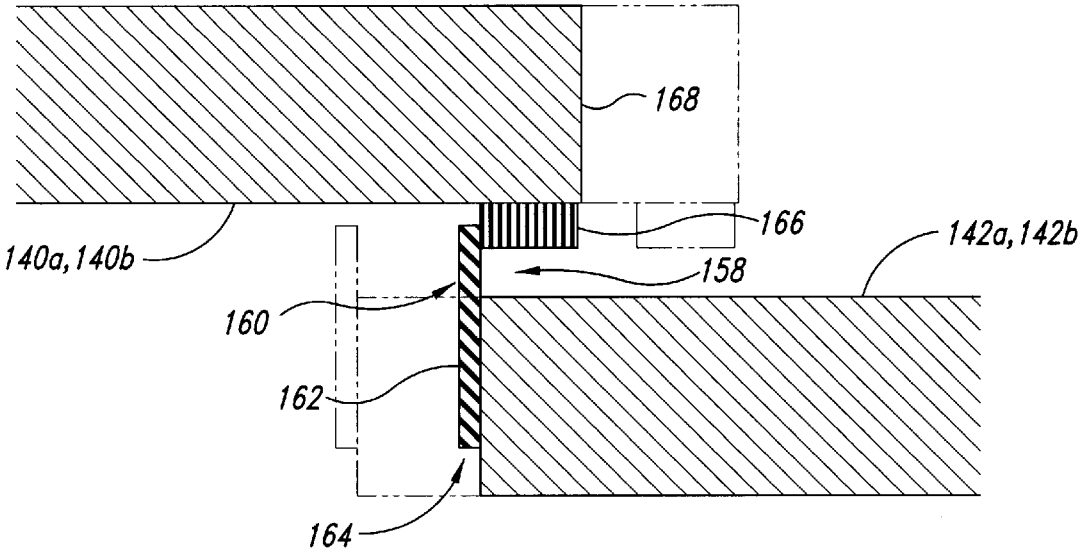
FIG. 12*a* is an enlarged detail view taken substantially at Detail 12*a,b* of FIG. 11 showing an interdoor edge seal structure between a pair of opposing hoistway door panels, the interdoor edge seal structure being shown in phantom lines in an unsealed position with the hoistway door panels in a partially closed position and shown in solid lines in a sealed position with the hoistway door panels in the closed position.

As best seen in FIG. 12*a*, the interdoor seal structure 160 includes an elongated interdoor lateral extension 162 secured to the trailing edge portion 164 of each of the outer hoistway doors 142*a* and 142*b* such that the interdoor lateral extension extends along the height of the respective hoistway door. The interdoor lateral extension 162 extends inwardly toward the respective inner hoistway doors 140*a* and 140*b* and into the respective interdoor lateral space 158. An elongated interdoor lateral seal 166 is connected to each of the inner hoistway doors 140*a* and 140*b* adjacent to the leading edge portion 168 such that the interdoor lateral seal extends into the respective interdoor lateral space 158 in an overlapping relationship with the associated interdoor lateral extension 162.

When the inner and outer hoistway doors 140*a*, 140*b*, 142*a* and 142*b* are moved between the partially closed position, the open position shown in phantom lines, the interdoor lateral extension 162 is out of engagement with the respective interdoor lateral seal 166, thereby minimizing frictional resistance to lateral movement of the inner and outer hoistway doors. When the inner and outer hoistway doors 140*a*, 140*b*, 142*a*, and 142*b* are moved to the fully closed position, as shown in solid lines in FIG. 12*a*, the interdoor lateral extension 162 presses against and sealably engages the interdoor lateral seal 166 to seal the respective interdoor lateral space 158 along the height of the hoistway doors, to block the flow of gas, smoke, or water through the interdoor lateral space 158 in the event of a fire or the like. In the preferred embodiment, the interdoor lateral extension 162 is a substantially rigid, blade-like member, and the interdoor lateral seal 166 is shaped, resilient, temperature resistive material that is slightly compressed by the interdoor lateral extension when the inner and outer hoistway doors 140*a*, 140*b*, 142*a* and 142*b* are in the closed position.

Figure 12B:
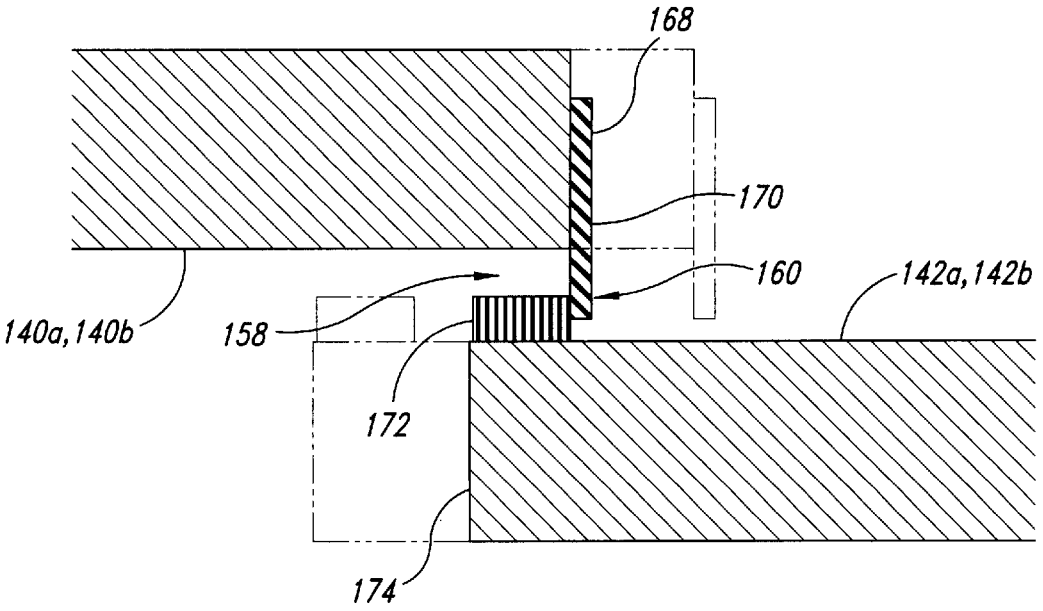
FIG. 12*b* is an enlarged detail view taken substantially at Detail 12*a,b* of FIG. 11 showing an alternate embodiment of an interdoor edge seal structure between a pair of opposing hoistway door panels, the interdoor edge seal structure being shown in phantom lines in an unsealed position with the hoistway door panels in the partially closed position and shown in solid lines in a sealed position with the hoistway door panels in the closed position.

In an alternate embodiment illustrated in FIG. 12*b*, the interdoor lateral seal structure 160 includes an elongated interdoor lateral extension 170 that is secured to the leading edge 168 of each of the left and right inner hoistway doors 140*a* and 140*b* and that projects outwardly toward the respective outer hoistway doors 142*a* and 142*b*. An elongated interdoor lateral seal 172 is securely attached to each of the outer hoistway doors 142*a* and 142*b* near the trailing edge portion 174 and extends into the respective interdoor lateral space 158 toward the respective inner hoistway doors 140*a* and 140*b*. The interdoor lateral seal 172 is positioned in an overlapping relationship with the associated interdoor lateral extension 170.

When the hoistway doors 140*a*, 140*b*, 142*a* and 142*b* move between the partially closed position and the open position shown in phantom lines, the interdoor lateral seal 172 is not in engagement with the interdoor lateral extension 170. When the hoistway doors 140*a*, 140*b*, 142*a*, and 142*b* are in the fully closed position shown in solid lines, the interdoor lateral seal 172 presses against and sealably engages the interdoor lateral extension 170 and provides a seal in the interdoor lateral space 158.

Figure 13:
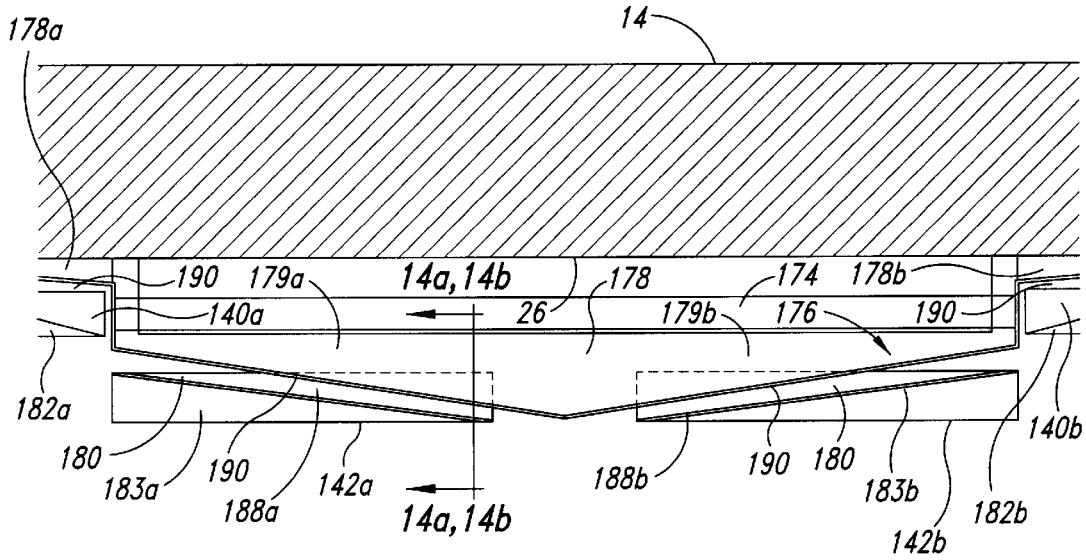
FIG. 13 is an enlarged partial plan view of a transverse edge of a pair of opposing hoistway door panels of FIG. 10 showing an angled transverse seal structure.

As best seen in FIG. 13, the embodiment having the inner and outer hoistway doors 140*a*, 140*b*, 142*a*, and 142*b* includes a transverse seal structure 176 to seal a transverse space 190 between the respective hoistway door and the headwall 26. The transverse seal structure 176 includes wall-mounted portions 178*a*, 178*b*, 179*a*, and 179*b* spaced apart from respective door-mounted portions 182*a*, 182*b*, 183*a*, and 183*b* on each of the hoistway doors 140*a*, 140*b*, 142*a*, and 142*b*, respectively. Each of the door-mounted portions 182*a*, 182*b*, 183*a*, and 183*b* have a construction substantially the same as the door-mounted seal portions 49 discussed above regarding the embodiment illustrated in FIGS. 4, 5*a* and 5*b*. The wall-mounted portions 178*a* and 178*b* that form a seal with the respective door-mounted portions 182*a* and 182*b* on the inner hoistway doors 140*a* and 140*b* each have a substantially similar construction as one-half of the wall-mounted portion 47 discussed above that engages a respective one of the door-mounted seal portions 49 as illustrated in FIGS. 4, 5*a*, and 5*b*. Accordingly, smoke, gas, and water are prevented from passing through the transverse space 190 when the inner hoistway doors 140*a* and 140*b* are in the closed position.

A transverse head panel 174 is mounted to the headwall 26 above the space between the inner hoistway doors 140*a* and 140*b* when in the fully closed position. The wall-mounted portions 179*a* and 179*b* of transverse seal structure 176 for the outer hoistway doors 142*a* and 142*b* are attached to the transverse head panel 174 which mounts them to the headwall 26, and the wall-mounted portions are integrally connected together to form a substantially triangular shape. Each of the wall-mounted portions 179*a* and 179*b* is spaced apart from the respective door-mounted seal portions 183*a* and 183*b* when the outer hoistway doors 142*a* and 142*b* are in the fully closed positions to define the transverse space 190 therebetween.

Figure 14A:
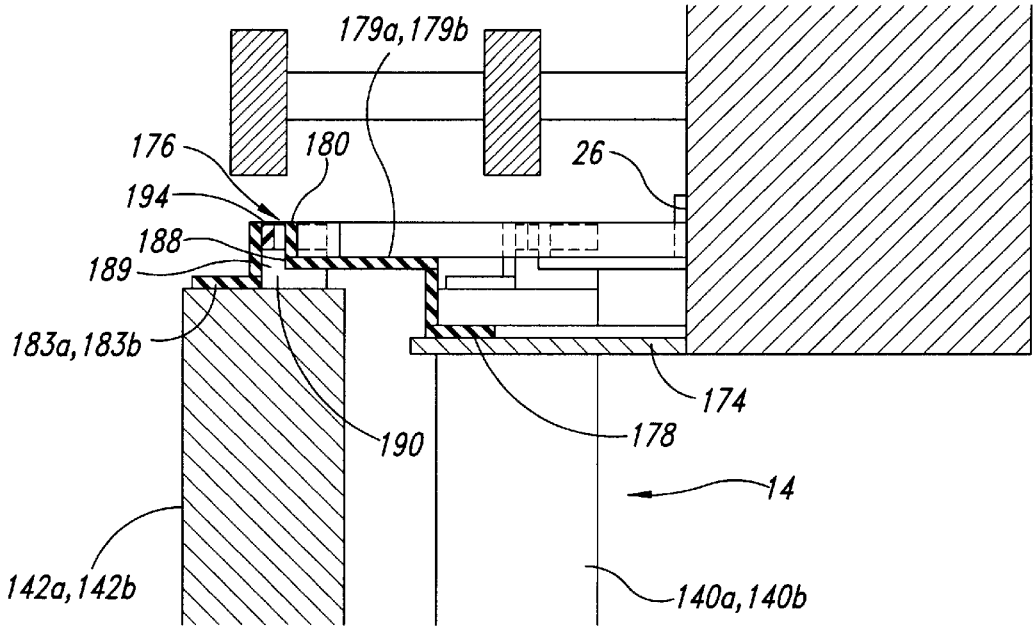
FIG. 14*a* is an enlarged cross-sectional view taken substantially along line 14*a,b*—14*a,b* of FIG. 13 showing a pair of opposing hoistway door panels and the transverse seal structure.

As best seen in FIG. 14*a*,the wall-mounted portion 179*a* and 179*b* of the transverse seal structure 176 for the outer hoistway doors 142*a* and 142*b* has a double-L cross-sectional shape with a lowermost horizontal leg 178 attached to the transverse head panel 174 and an upper vertical leg 180 spaced apart from the transverse head panel. The upper vertical leg 180 of each wall-mounted portion 179*a* and 179*b* is oriented at an angle relative to the headwall 26, so that the upper vertical leg extends laterally outward away from the vertical center line of the hoistway entrance 14 and toward the headwall. The upper vertical legs 180 are connected to each other at a position away from the headwall 26 and aligned with the center line of the hoistway entrance 14.

Each upper vertical leg 180 has a seal mating surface 188 that faces away from the headwall 26 and toward a seal engaging surface 189 of the respective door-mounted portions 183*a* and 183*b*. The seal mating surfaces 188 are parallel to the respective seal engaging surfaces 189, and the angular orientation of the seal mating and seal engaging surfaces relative to the headwall 26 is such that the distance between the seal engaging surface and the respective seal mating surface increases as the hoistway doors 142*a* and 142*b* move toward the open position and decreases as the hoistway doors move toward the fully closed position. The seal mating surfaces 188 and the respective seal engaging surfaces 189 are spaced apart from each other when the hoistway doors 142*a* and 142*b* are in the fully closed position (as illustrated) to define the transverse space 190 therebetween.

An elongated transverse seal 194 is attached to the seal engaging surface 188 of each door-mounted portions 183*a* and 183*b*, and the transverse seal projects toward the respective seal mating surface 188 into the transverse space 190. When the hoistway doors 142*a* and 142*b* are moved between the partially closed position and the open position, the transverse seals 194 do not engage the respective seal mating surfaces 188, thereby minimizing frictional resistance to lateral movement of the hoistway doors. When the hoistway doors 142*a* and 142*b* are in the fully closed position, the transverse seal 194 is pressed into sealable engagement with the respective seal mating surface 188 to provide a barrier that substantially prevents smoke, gas, and water from passing through the transverse space 190. In the preferred embodiment, each of the elongated transverse seals 194 are constructed of a shaped, resilient, temperature resistive material that is slightly compressed when the hoistway doors 142*a* and 142*b* are moved to the fully closed position.

Figure 14B:
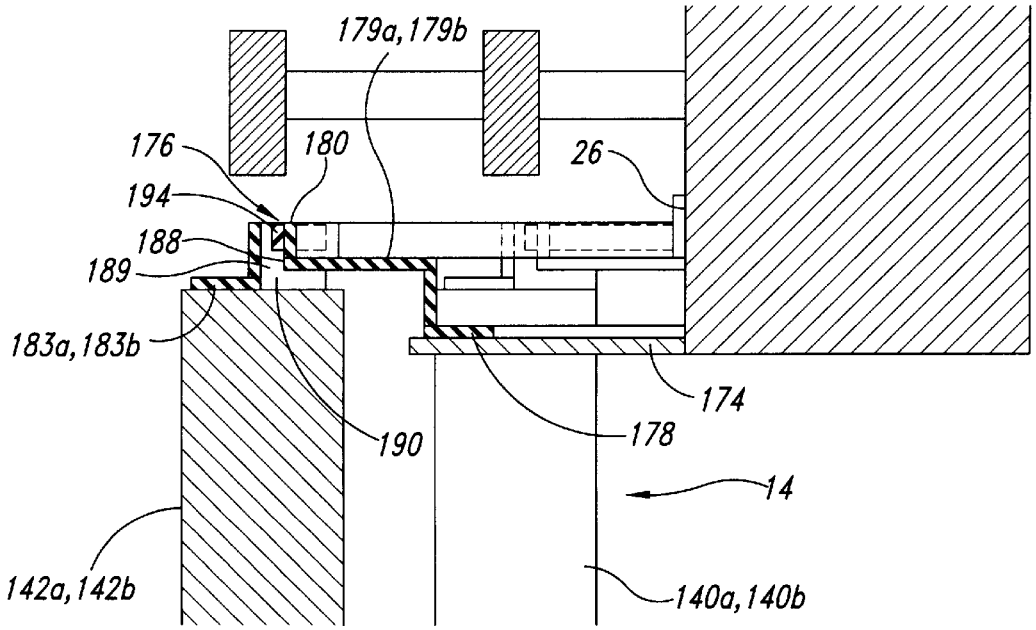
FIG. 14*b* is an enlarged cross-sectional view taken substantially along line 14*a,b*—14*a,b* of FIG. 13 showing the pair of opposing hoistway door panels with an alternate embodiment of the transverse seal structure.
Figure 15:
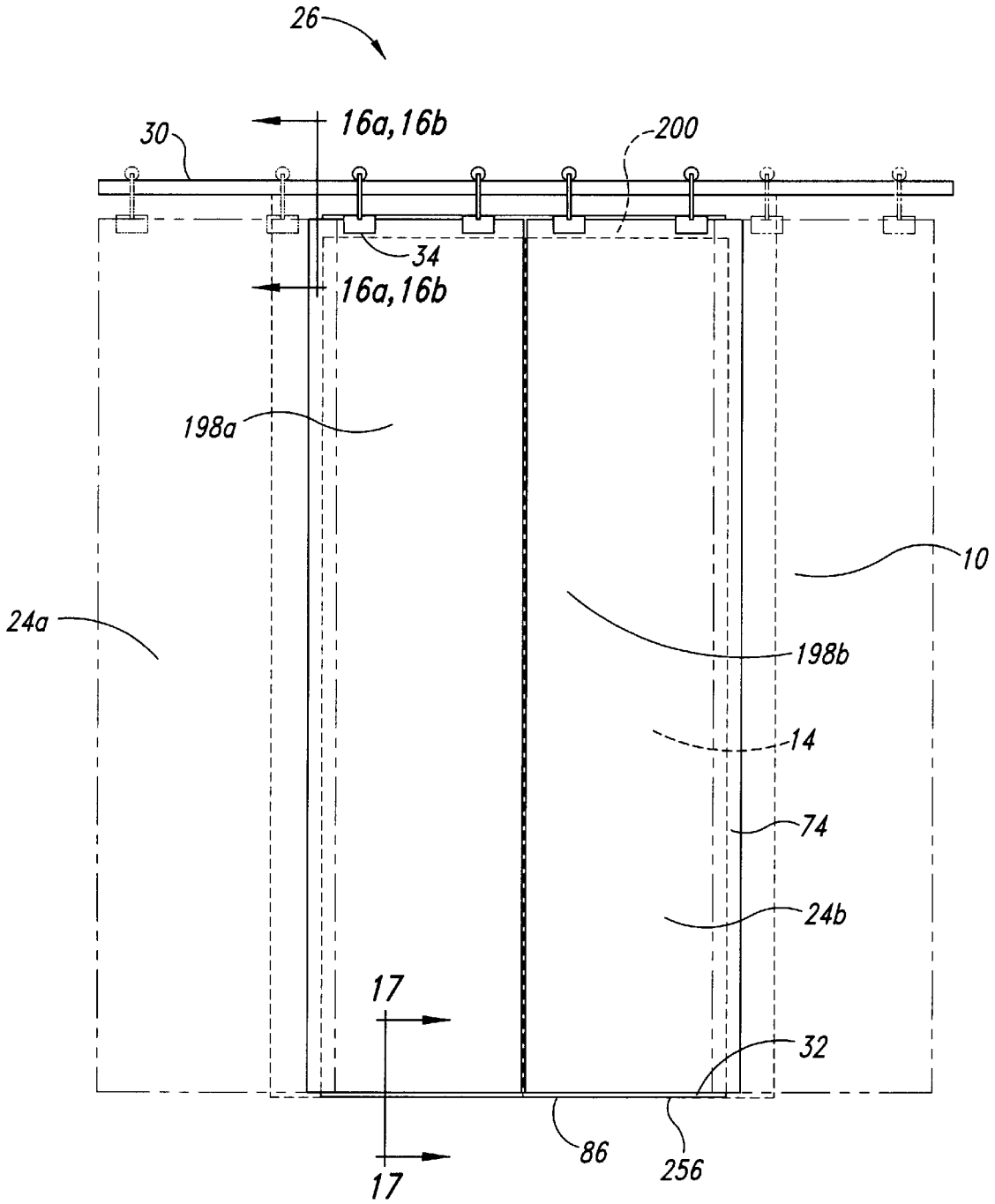
FIG. 15 is an enlarged side elevation view of an alternate embodiment of the elevator hoistway seal structure of FIG. 1 with an opposing hoistway door arrangement shown supported from a support member above the hoistway entrance, the hoistway doors being shown in solid lines in a closed position and shown in phantom lines in an open position.

In an alternate embodiment illustrated in FIG. 14*b* the transverse seals 194 are attached to the seal mating surfaces 188 of the respective wall-mounted portions 179*a* and 179*b* and project toward the respective seal engaging surfaces 189 of the door-mounted portions 183*a* and 183*b* and seal the respective transverse spaces 190 when the hoistway doors 142*a* and 142*b* are in the closed position As best seen in FIG. 15 another alternate embodiment is illustrated with a transverse brush-seal structure 200 provided between the headwall 26 and the top of opposing hoistway doors 198*a* and 198*b*, shown in the open position by phantom lines and shown by solid lines in the closed and sealed position. Although the illustrated embodiment includes a pair of opposing hoistway doors, the door assembly can have other configurations, such as a single door configuration, or a configuration having a multiple panel pair of opposing doors, as discussed above. Each of the hoistway doors 198*a* and 198*b* are movably attached to the elongated door support member 30 by a pair of the door supports 34 as described above for lateral movement in a substantially vertical plane relative to the headwall 26 between the open and fully closed positions.

Figure 16A:
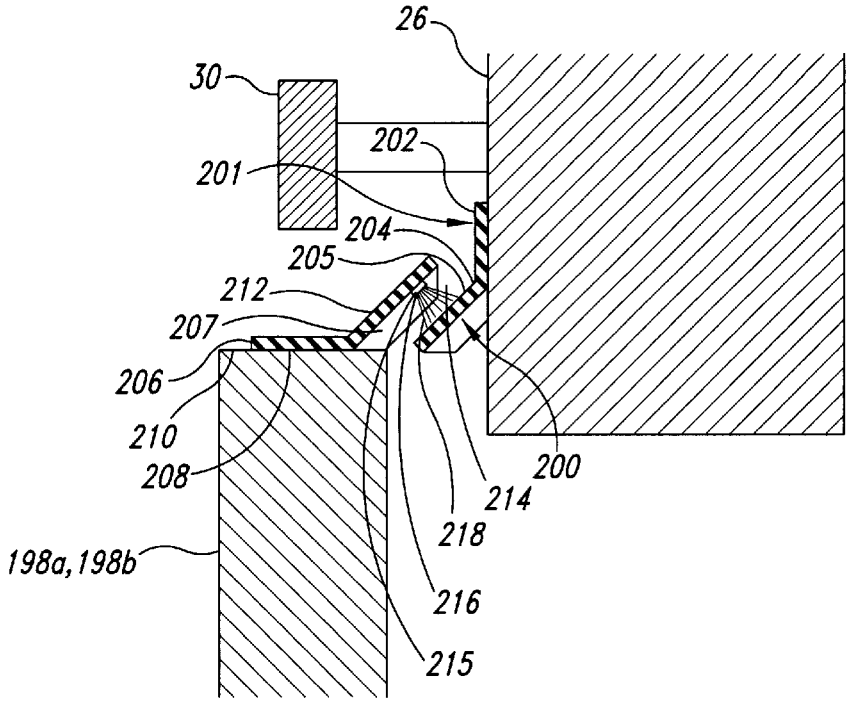
FIG. 16*a* is an enlarged cross-sectional view taken substantially along line 16*a,b*—16*a,b* of FIG. 15 showing an alternate embodiment of the transverse seal structure; door support trucks are not shown for purposes of clarity.

As best seen in FIG. 16*a*, the transverse seal structure 200 has a wall-mounted portion 201 mounted to the headwall 26 below the elongated door support member 30. The wall-mounted portion 201 has a vertical leg 202 securely attached to the headwall 26 and an angled leg 204 projecting downwardly and outwardly away from the headwall 26 at approximately a 45-degree angle. The wall-mounted portion 201 has left side and right side portions which each extend laterally from the center of the hoistway entrance 14 toward a respective one of the left and right jamb walls 24*a* and 24*b* (FIG. 15). The angled leg 204 of each of the left and right side portions of the wall-mounted portion 201 is positioned spaced away from the headwall 26 at the center of the hoistway entrance 14 and is positioned progressively closer to the headwall 26 as the wall-mounted portion 201 extends laterally toward the respective left and right jamb walls 24*a* and 24*b*, and the angled leg 204 is positioned close to the headwall at the left and right most extent of the wall-mounted portion 201 (as shown in FIG. 16*a*). Accordingly, the angled leg 204 provides an angled sealing surface 205 that is angled in two directions relative to the headwall 26.

The transverse seal structure 200 has door-mounted portions 206, each with a horizontal leg 208 securely attached to a top transverse edge 210 of the respective hoistway doors 198*a* and 198*b*, and an angled leg 212 that projects upwardly and inwardly away from the transverse edge and toward the headwall 26. The angled leg 212 is also positioned farther from the headwall 26 toward the leading edge of the respective hoistway door 198*a* and 198*b* to which mounted and is positioned progressively closer to the headwall as the door-mounted portion 206 extends laterally outward such that the angled leg 212 of the door-mounted portion 206 is substantially parallel to the angled leg 204 of the respective wall-mounted portion 201. The angled leg 212 of each door-mounted portion 206 has a sealing surface 207 that faces downwardly and toward the headwall 26. The angular orientation of the angled legs 204 and 212 is such that the space between the angled legs decreases as the hoistway doors 198*a* and 198*b* move laterally toward the fully closed position.

The angled legs 204 and 212 are positioned to provide a transverse space 214 therebetween when the hoistway doors 198*a* and 198*b* are in the fully closed position. A bristle seal 215 is sealably attached to the sealing surface 207 of each angled leg 212 of the door-mounted portion 206 by a bristle carrier 216, and a row of bristles 218 extends away from the bristle carrier. The bristles of the row of bristles 218 have a length sized so that the bristles brush against and sealably engage an upwardly and outwardly facing sealing surface 205 of the respective wall-mounted portion's angled leg 204 when the hoistway door 198*a* and 198*b* moves to the fully closed position, thereby blocking the flow of gas or smoke through the transverse space 214 in the event of a building fire or the like. When the hoistway doors 198*a* and 198*b* are moved between the partially closed position and the open position, the rows of bristles 218 are out of engagement with the sealing surface 205 of the wall-mounted portion's angled leg 204 so as to minimize frictional resistance to lateral movement of the hoistway doors and to minimize wear on the bristles.

In the preferred embodiment, the row of bristles 218 and the bristle carrier 216 are adapted to maintain the bristle seal's structural integrity in elevated temperatures, such as temperatures experienced in a building fire. Accordingly, a seal is maintained between the hoistway doors 198*a* and 198*b* and the headwall 26 during a building fire.

Figure 16B:
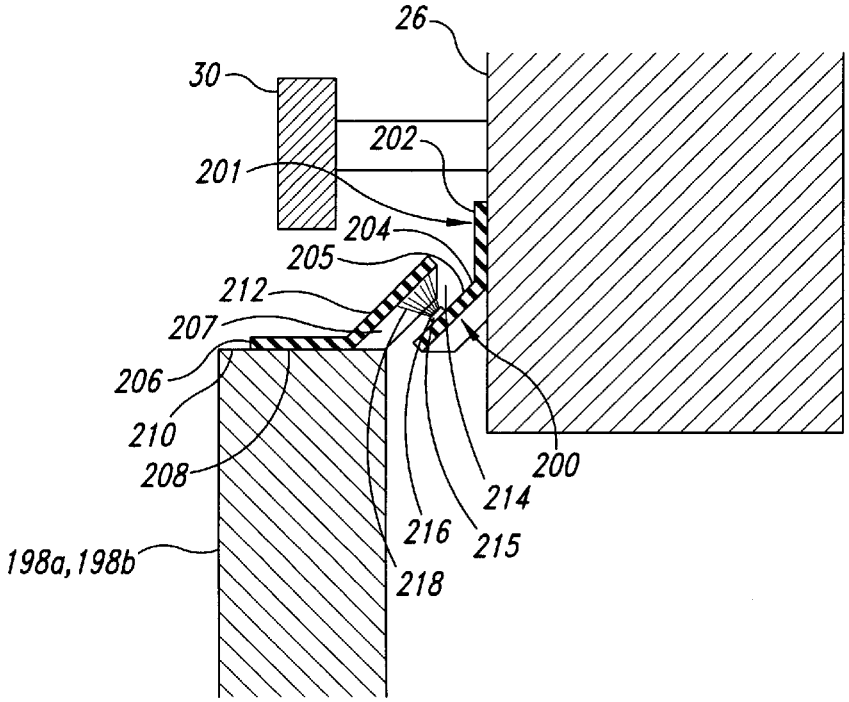
FIG. 16*b* is an enlarged cross-sectional view taken substantially along line 16*a,b*—16*a,b* of FIG. 15 showing another alternate embodiment of the transverse seal structure; door support trucks are not shown for purposes of clarity.

As best seen in FIG. 16*b*, an alternate embodiment of the transverse seal structure 200 is shown with the bristle seal 215 having the bristle carrier 216 sealably attached to the wall-mounted portion's angled leg 204, and the row of bristles 218 extend upward therefrom. The row of bristles 218 sealably engage the sealing surface 207 of the respective door portion's angled leg 212 when the hoistway door 198*a* and 198*b* are in the closed position, and the row of bristles are out of engagement when the hoistway door moves between the partially closed position and the open position.

Figure 17:
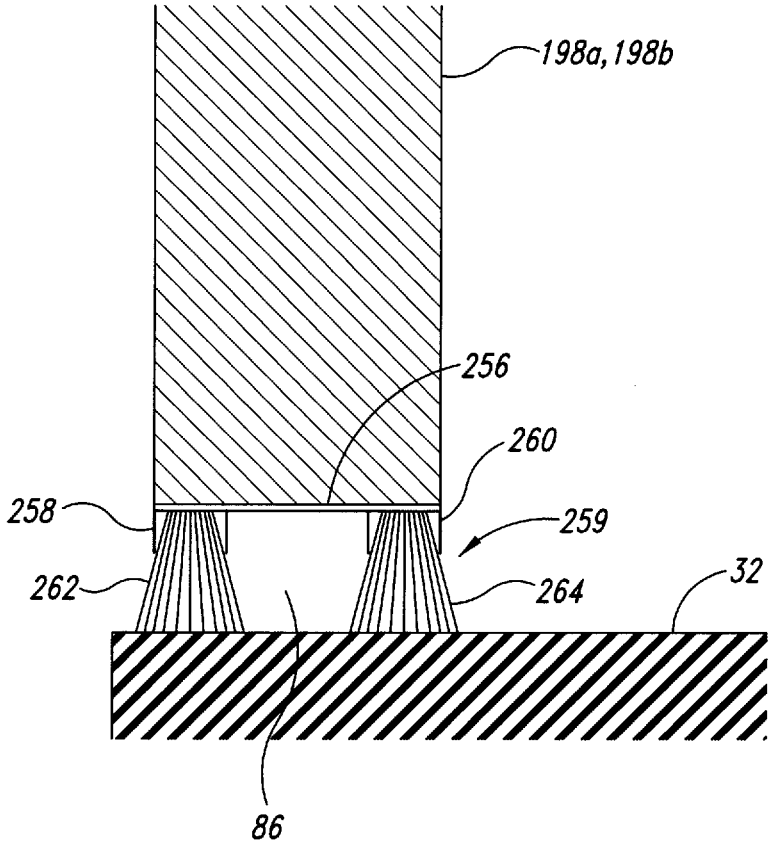
FIG. 17 is an enlarged cross-sectional view taken substantially along line 17—17 of FIG. 15 showing a sill seal structure.

Referring to FIG. 15, the bottom edge 256 of each hoistway door 198*a* and 198*b* is positioned above the sill 32 at a selected distance that defines the sill space 86 between the hoistway doors and the sill. As best seen in FIG. 17, a bottom door seal structure 258 is securely attached to the bottom edge 256 of each hoistway door 198*a* and 198*b*. The bottom door seal structure 258 has a bristle seal 259 having a bristle carrier 260 sealably attached to the bottom edge 256 of each hoistway door 198*a* and 198*b*. An inner and outer row of bristles 262 and 264 are mounted to the bristle carrier 260 and are spaced apart from each other.

The rows of bristles 262 and 264 extend downwardly toward the sill 32 and sealably touch the sill 32 to seal the sill space 86 to substantially restrict smoke and gas from passing therethrough in the event of a fire. In the preferred embodiment, the rows of bristles 262 and 264 and the bristle carrier 258 are adapted to maintain their structural integrity in elevated temperatures, such as the temperatures experienced in a building fire. The preferred brush seal 259 has stainless steel bristles that lightly touch the sill 322 as the hoistway doors 198*a* and 198*b* are moved to the closed position thereby minimizing frictional resistance during movement of the hoistway doors.

The hoistway door assembly 22 of the present invention provides the various seal structures that seal the spaces around the hoistway doors and the hoistway entrance when the hoistway doors are in the fully closed position so as to substantially prevent smoke, gas, and water from moving into or out of the hoistway 14 in the event of a fire or the like. Accordingly, the hoistway 14 is maintained with a substantially smoke-free environment in the event of a fire, thereby allowing the elevator car to continue operation through the hoistway, as an example, to evacuate non-ambulatory persons from floors above and below the fire floor. The hoistway 14 will remain in the smoke-free condition until a seal is breached. The seal structures around the hoistway doors and the hoistway entrance also substantially prevent smoke or gas within the hoistway from passing through the hoistway entrance onto other floors within a building that are above and below the fire floor. Accordingly, the elevator lobbies on each of the building floors away from the fire floor will remain substantially smoke and gas free. This smoke- and gas-free elevator lobby on the floors of the building provides an evacuation assistance area in which people can wait until they are evacuated by the fire department or until the elevators are returned to normal operation.

Numerous modifications and variations of the hoistway door seal structure of the present invention disclosed herein will occur to those skilled in the art in view of this disclosure. Therefore, it is to be understood that these modifications and variations, and equivalents thereof, may be practiced while remaining within the spirit and the scope of the invention as defined by the following claims.

I claim:

1. A hoistway door seal structure for limiting the flow of air into or out of a hoistway, comprising:

a wall structure having an opening therein defining a hoistway entrance;

a hoistway door sized to substantially cover the hoistway entrance when in a fully closed position and to allow access to the hoistway through the hoistway entrance when in a fully open position;

an elongated door support member positioned in a generally horizontal orientation and connected to the wall structure;

a door support device connected to the hoistway door and movably supported by the elongated door support member to support the hoistway door for substantially planar movement of the hoistway door in a lateral direction between the fully open position and the fully closed position, when in the fully closed position a space is provided between the hoistway door and the wall structure; and a seal structure positioned in the space between the hoistway door and the wall structure when the hoistway door is in the fully closed position, the elongated door support member adapted to guide the hoistway door to move along a path of movement in a selected direction relative to the seal structure between a partially closed position and the fully closed position as the hoistway door is moved into and out of the fully closed position, the seal structure having a door-mounted portion with a seal engaging surface positioned at a selected angle relative to the wall structure, a wall-mounted portion having an angled seal mating surface positioned substantially parallel to the seal engaging surface, and a seal attached to one of the seal mating surface and the seal engaging surface and sealably engaging the other of the seal mating surface and the seal engaging surface to seal the space between the hoistway door and the wall structure when the hoistway door is moved into the fully closed position to limit smoke flow through the hoistway entrance, the seal being spaced apart from the other of the seal mating surface and the seal engaging surface and out of engagement therewith when the hoistway door is moved into the partially closed position.

2. The hoistway door seal structure of claim 1 wherein the seal is mounted to the seal engaging surface of the door-mounted portion.

3. The hoistway door seal structure of claim 1 wherein the seal is a brush seal.

4. The hoistway door seal structure of claim 1 wherein the hoistway door includes a pair of opposing hoistway door portions.

5. The hoistway door seal structure of claim 1 wherein the seal structure is a transverse seal structure attached to a top portion of the hoistway door and to a portion of the wall structure above the hoistway entrance.

6. A hoistway door seal structure for limiting the flow of fluid into or out of a hoistway to restrict the passage of smoke and water into or out of the hoistway in the event of a fire, comprising:

a wall structure having an opening therein defining a hoistway entrance having a headwall, a pair of lateral jambs and a sill;

a pair of opposing hoistway doors sized to substantially cover the hoistway entrance when in a fully closed position and to allow access to the hoistway through the hoistway entrance when in a fully open position, each of the hoistway doors having a lateral portion, a meeting edge, a top portion, and a bottom portion;

a door support rail positioned in a generally horizontal orientation and connected to the wall structure, the door support rail having a roller support surface;

at least one door support truck connected to each door, each door support truck having a support roller engaging the roller support surface of the support rail to support a respective one of the opposing hoistway doors while permitting substantially planar movement of the respective one of the hoistway doors in a substantially lateral direction between the fully open position and the fully closed position, wherein when in the fully closed position the hoistway doors are spaced from the sill to define sill spaces, spaced from the headwall to define transverse spaces, and spaced from the lateral jambs to define lateral spaces, and the meeting edges of the hoistway doors are spaced from each other to define a meeting edge space;

an elongated lateral extension extending from a lateral portion of each hoistway door toward the wall structure;

lateral seals extending from the wall structure toward the hoistway doors in an overlapping relationship with a respective one of the lateral extensions extending from the hoistway doors to sealably engage the respective one of the lateral extensions to seal the lateral spaces when the hoistway doors are in the fully closed position;

an elongated seal connected to the meeting edge of one of the hoistway doors, the elongated seal being sized to sealably engage the meeting edge of the other doors when the hoistway doors are in the fully closed position to seal the meeting edge space;

elongated transverse extensions extending from the top portion of each hoistway door toward the wall structure, each of the transverse extensions having first and second ends and a sealing surface extending therebetween, the first end being spaced a first distance from the headwall and the second end being spaced a second distance from the headwall that is different than the first distance so the sealing surface is at an angle relative to the headwall;

elongated transverse mating structure extending from the headwall toward the transverse extensions, each of the transverse mating structures having a seal mating surface substantially parallel to the sealing surface of a respective transverse extension; and an elongated seal connected to the one of the seal mating surface and the sealing surface, the roller support surface of the door support rail having guide portions to guide the hoistway doors to move along a path of movement in a selected direction relative to the transverse mating structures between a partially closed position and the fully closed position as the hoistway doors are moved into and out of the fully closed position, the seal being in sealable engagement with the sealing surface of the transverse extension and the seal mating surface of the transverse mating structure to seal the transverse spaces when the hoistway doors are moved into the fully closed position, and the sealing surface of the transverse extensions being spaced apart from the seal mating surface of the transverse mating structure with the seal being out of engagement with the other one of the seal mating surface and the sealing surface when the hoistway doors are moved into the partially closed position.

7. The hoistway door seal structure of claim 6 wherein the path of movement along which the guide portions guide the hoistway doors relative to the transverse seals is oriented transverse to the lateral direction of the substantially planar movement of the hoistway doors.

8. The hoistway door seal structure of claim 6 wherein the seal is mounted to the sealing surface of the transverse extension.

9. The hoistway door seal structure of claim 6, wherein the seal is a bristle seal.

10. The hoistway door seal structure of claim 6, further comprising a sill seal attached to the bottom portion of each hoistway door, the sill having a seal engaging surface, and the sill seal having sealing surface positioned at a selected angle relative to the headwall and substantially parallel to the seal engaging surface, the sealing surface being moved into sealable engagement with the seal engaging surface of the sill when the hoistway door is moved into the fully closed position, and the sealing surface being out of engagement with the seal engaging surface when the hoistway door is moved into the partially closed position.

* * * * *